US012709944B2

(12) United States Patent
Torres et al.

(10) Patent No.: US 12,709,944 B2
(45) Date of Patent: Aug. 18, 2026

(54) MASS FLOW FOR NON-CONTACT BORING

(71) Applicant: Phoenix Boring, Inc., San Francisco, CA (US)

(72) Inventors: Shivani Torres, San Francisco, CA (US); Ryan Benson, San Francisco, CA (US); Thorin Tobiassen, San Francisco, CA (US)

(73) Assignee: Phoenix Boring, Inc., San Francisco, CA (US)

( * ) Notice: Subject to any disclaimer, the term of this patent is extended or adjusted under 35 U.S.C. 154(b) by 0 days.

(21) Appl. No.: 19/252,905

(22) Filed: Jun. 27, 2025

(65) Prior Publication Data

US 2025/0320782 A1 Oct. 16, 2025

Related U.S. Application Data

(63) Continuation of application No. PCT/US2023/086430, filed on Dec. 29, 2023.

(60) Provisional application No. 63/478,086, filed on Dec. 30, 2022.

(51) Int. Cl.
*E21B 7/14* (2006.01)
*E21B 21/16* (2006.01)

(52) U.S. Cl.
CPC ..... *E21B 7/14* (2013.01); *E21B 7/146* (2013.01); *E21B 21/16* (2013.01)

(58) Field of Classification Search
CPC ..... E21B 7/14; E21B 21/16
See application file for complete search history.

(56) References Cited

U.S. PATENT DOCUMENTS

| | | | |
|---|---|---|---|
| 2010/0206635 A1 | 8/2010 | Harrison et al. | |
| 2013/0008718 A1 | 1/2013 | Nguyen et al. | |
| 2013/0098043 A1 | 4/2013 | Surjaatmadja | |
| 2022/0220851 A1* | 7/2022 | Helming | E21D 9/1073 |

FOREIGN PATENT DOCUMENTS

| | | |
|---|---|---|
| WO | 2022256795 A1 | 12/2022 |
| WO | 2024145582 A1 | 7/2024 |

OTHER PUBLICATIONS

International Application Serial No. PCT/US23/86430, Search Report and Written Opinion mailed May 1, 2024, 8 pgs.

* cited by examiner

*Primary Examiner* — Tara Schimpf
*Assistant Examiner* — Lamia Quaim
(74) *Attorney, Agent, or Firm* — Polygon IP, LLP

(57) ABSTRACT

The systems and techniques described herein illustrate mass flow configurations for non-contact boring. Mass flow described herein may be utilized for various different purposes. In certain embodiments, a conical head may be disposed on the system of the non-contact boring system and may cause air to circulate in a manner that causes spoil to be airborne in front of the bore face, allowing for improved excavation of spoil generated by the non-contact boring.

19 Claims, 15 Drawing Sheets

300C

MASS FLOW FOR NON-CONTACT BORING

CROSS-REFERENCE TO RELATED APPLICATIONS

This application is a continuation of and claims priority to PCT Application No. PCT/US23/86430, filed on 2023 Dec. 29, which claims priority to U.S. Provisional Application No. 63/478,086, filed on 2022 Dec. 30. Each application is incorporated herein by reference in its entirety for all purposes.

TECHNICAL FIELD

This invention relates generally to the field of subterranean excavation and more specifically to new and useful methods for underground boring, as well as trenching, with new and useful non-contact boring systems in the field of underground boring and trenching.

BACKGROUND

Traditional boring techniques engage the ground through contact, and thus are limited by thrust and torque. By extension, conventional techniques are limited in face monitoring, steering, and localized control of the cutting action at the face. Thus, traditional boring techniques struggle with various boring conditions and requirements and, accordingly, are limited in their ability to conduct versatile boring operations.

SUMMARY

Described herein are new methods and systems for non-contact boring. In various embodiments, a system may be disclosed. The system may include a non-contact boring element configured to perform thermal spallation on a bore face of a borehole, a conical head comprising a spoil removal opening, a first vacuum, fluidically coupled to the spoil removal opening and configured to generate vacuum to remove spoil created by the thermal spallation, a first sensor, configured to determine a rate of mass flow through the non-contact boring element, a second sensor, configured to determine an amount of the vacuum generated, and a controller, communicatively coupled to the first sensor and the second sensor and configured to determine the rate of mass flow through the non-contact boring element, determine the amount of the vacuum generated, and adjust operation of the non-contact boring element and/or the first vacuum based on the determined rate of mass flow and the determined amount of the vacuum.

In another embodiment, a method may be disclosed. The method may include determining, with a first sensor, a rate of mass flow through a non-contact boring element configured to perform thermal spallation on a bore face of a borehole, determining, with a second sensor, an amount of the vacuum generated by a first vacuum, the first vacuum fluidically coupled to a spoil removal opening and configured to generate vacuum to remove spoil created by the thermal spallation, and adjusting operation of the non-contact boring element and/or the first vacuum based on the determined rate of mass flow and the determined amount of the vacuum.

DETAILED DESCRIPTION

Figure 1A:
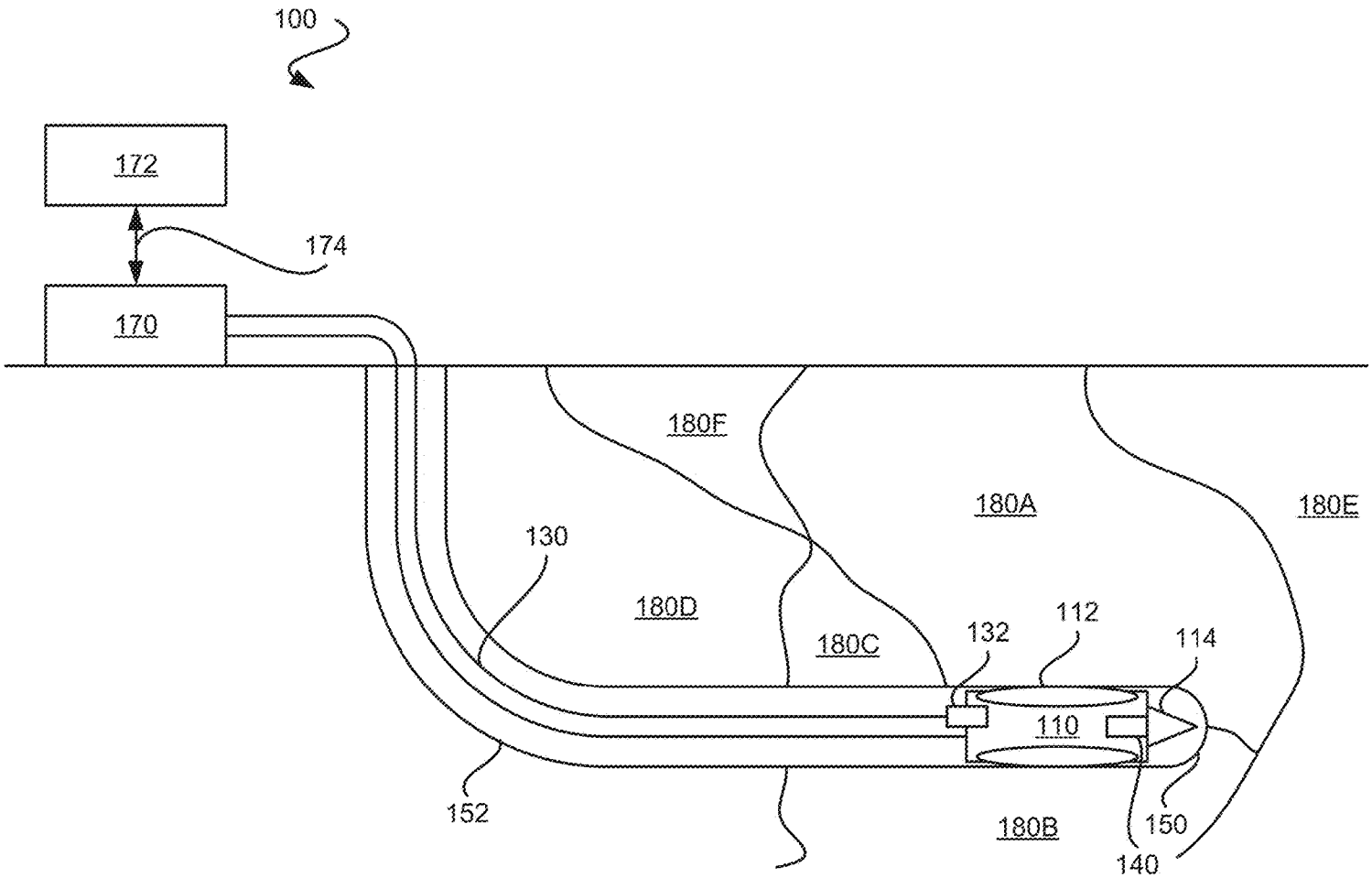
FIG. 1A illustrates a representation of an example boring situation, in accordance with certain embodiments.

In the following description, numerous specific details are outlined to provide a thorough understanding of the presented concepts. The presented concepts may be practiced without some or all of these specific details. In other instances, well-known process operations have not been described in detail to not unnecessarily obscure the described concepts. While some concepts will be described in conjunction with the specific embodiments, it will be understood that these embodiments are not intended to be limiting.

In the following description, various techniques and mechanisms may have been described in singular form for clarity. However, it should be noted that some embodiments include multiple iterations of a technique or multiple instantiations of a mechanism unless otherwise noted. For example, an excavation system may be described with a cutterhead, but can include a plurality of cutterheads while remaining within the scope of the present disclosure unless otherwise noted. Similarly, various techniques and mechanisms may have been described as including a connection between two entities. However, a connection does not necessarily mean a direct, unimpeded connection, as a variety of other entities (e.g., fasteners, spacers, fittings etc.) may reside between the two entities.

It is appreciated that, for the purposes of this disclosure, when an element includes a plurality of similar elements distinguished by a letter following the ordinal indicator (e.g., "908A" and "908B") and reference is made to only the ordinal indicator itself (e.g., "908"), such a reference is applicable to all the similar elements.

Introduction

Traditional boring techniques suffer from a variety of limitations. The non-contact boring systems and techniques described herein may allow for overcoming these limitations. Non-contact boring techniques, such as the techniques described herein, may utilize thermal spallation through the operation of a thermal cutterhead. The thermal cutterhead may be a combuster such as a turbine, afterburner, air breathing rocket, flame torch, plasma, and/or other system that provides heat and thrust. Such combusters typically require a high amount of airflow for operations, especially when a combuster such as an afterburner, rocket, or torch is utilized. The airflow provides oxygen for the operation of the combuster. The large amount of oxygen required to operate the combuster is not available in a typical borehole.

Conventional boring techniques do not require a large amount of oxygen and, thus, do not have the airflow requirements of the non-contact boring techniques described herein. The high amount of airflow required for the non-contact boring techniques described herein allow for alternative usages of such airflow, including cooling, spoil evacuation, and system cleaning. The systems and techniques described herein utilize such mass flow of oxygen and other fluids for operation of non-contact boring and provide techniques for controlling the mass flow through the systems to provide control of the non-contact boring techniques described herein.

In various embodiments, non-contact boring may include boring techniques that utilize a thermal cutterhead. The thermal cutterhead may be, for example, combusters such as turbine combusters, turbine-less combusters, afterburners, air-breathing rockets, and/or fuel combustion torches. The thermal cutterhead may also be, in certain other examples, plasma, water jet, and/or other such techniques that utilize heat, mass flow, and/or a combination thereof to perform boring. Non-contact boring techniques may include, for example, utilizing a turbine to effect thermal spallation of a bore face of a borehole.

Mass flow of various items include, e.g., air, oxygen, spoil, and other items utilized and/or generated during non-contact boring. For example, certain non-contact boring systems described herein (e.g., the systems utilizing a combuster such as a turbine or another non-contact boring element where mass is flowed through the element) requires positive pressure exiting from the exhaust of the turbine (e.g., either conventional exhaust or an afterburner of the turbine). In such an embodiment, the presence of back pressure within the system may cause the turbine to cease operating, extinguish the afterburner flame, and/or cause the afterburner flame to be unstable.

Accordingly, the system and techniques described herein allow for a vacuum to be maintained to create flow at the bore face. The vacuum allows for stable operation of the combuster as the combuster does not experience any back pressure. Furthermore, the vacuum exposes fresh rock at the bore face, in order to drive the thermal spallation process.

The systems and techniques described herein include customizable elements that effects mass flow. For example, the cutterhead may include specific elements such as a turbine or torch. A turbine may include specific elements such as the number and size of capillary tubes. A torch or afterburner may include elements such as a flame holder, hole pattern and/or air fuel mixture to effect ignition as well as flame stability. Backup system elements such as lengths and diameter of hoses, volume of airflow, volume of liquid flow, temperature of the operation and various forms of active and passive cooling may also be customized.

For the purposes of this disclosure, references to various permutations of "boring" may refer 1) to "boring" for investigation, assessment, and/or installation of various installations, 2) to "drilling" for extraction of materials, 3) to "trenching," 4) to "rehabilitation" of existing bores and/or structures, and/or 5) to any other technique that includes the excavation, removal of, or disturbance of subterranean materials.

Example Boring Situations

FIG. 1A illustrates a representation of an example boring situation, in accordance with certain embodiments. FIG. 1A illustrates system 100 that may be used for various boring scenarios. System 100 may include chassis 110 with drivetrain 112 and non-contact boring element 114. Chassis 110 and the elements thereof may be coupled to onsite facility 170 via umbilical cord 130. Onsite facility 170 may, in certain embodiments, be optionally communicatively coupled to offsite controller 172 via communications medium 174, which may be wired and/or wireless communications medium configured to provide and receive data, such as Internet, satellite communications, cable communications, and/or other types of communications techniques.

Chassis 110 may be any type of chassis where elements of a boring system may be coupled to thereof (e.g., non-contact boring element 114 may be coupled to chassis 110). Thus, chassis 110 may, in certain embodiments, be a space frame, sled, and/or other such chassis. Drivetrain 112 may be coupled to chassis 110 and may include a set of wheels or tracks driven by an electric, hydraulic, and/or pneumatic motor. Drivetrain 112 may be configured to move chassis 110, and the elements coupled thereof, downhole to position chassis 110.

Non-contact boring element 114 may be coupled to chassis 110 and may be configured to excavate portions of a geological formation through a non-contact technique, such as through the use of heat, mass flow, a combination of the two, and/or a similar non-contact technique. Non-contact boring element 114 may include one or more of a cutterhead, a plasma torch, a turbine exhaust, turbine exhaust plus afterburner, a torch, a rocket, a flame jet, a pneumatic drill, a water jet, a steam or gas jet, an abrasive material jet, a sonic wave generator, an electromagnetic or particle beam, and/or any similar non-contact technique.

System 100 may further include sensors (as described herein), a spoil removal system 132 configured to draw or force waste (e.g., gas, spall, tailing, and/or other waste) from between the boring element(s) and bore face 150. Spoil removal system 132 may be configured to remove such waste to a region out of borehole 152 and/or away from bore face 150. A filtration or collection element 140 may, additionally or alternatively, be configured to collect spoil at bore face 150 (e.g., debris or waste created by the excavation of borehole 152 or bore face 150). Removal of such waste or spoil may be via umbilical cord 130, which may be configured to receive such materials from spoil removal system 132 and/or filtration or collection element 140. Filtration or collection element 140 may collect spoil and filter out appropriate size spoil for analysis (e.g., mineralogy analysis at, for example, onsite facility 170. Spoil collect may include solid spoil as well as liquid and/or gaseous spoil (e.g., vapors).

In various embodiments, borehole 152 may be a tunnel, trench, or other feature created by system 100. Borehole 152 may, in various embodiments, be a lined or unlined borehole. In embodiments where borehole 152 is typically unlined, the sensors of system 100 may generate a three-dimensional spatial and surface finish map of borehole 152 via data from sensors described herein. Such sensors may include, for example, one or more cameras, radar, lidar, and/or other such sensors. From such a map, one or more controllers of system 100 may generate an image or model and determine whether borehole 152 is suitable for use without a liner or whether a liner is needed. For example, some types of geology may yield hard and smooth bored surfaces, for which an interior liner may not be necessary. Other types of geology may yield softer or more jagged bored surfaces, for which an interior liner may be desirable. Borehole 152 may include both types of example geologies, as well as other such geologies.

Umbilical cord 130 may be configured to allow for communication between onsite facility 170 and chassis 110 and, thus, between onsite facility 170, as well as other facilities and controllers associated with boring, and the boring elements and/or other elements coupled to chassis 110. Such communications may include data communications (e.g., for communications of sensor data and/or for communications of instructions) as well as material communications (e.g., of waste from bore face 150 to the surface). Umbilical cord 130 may also be configured to provide electrical power, combustion material, and/or gas between chassis 110 and onsite facility 170. Though the embodiment described herein may communicate data and/or signals via a physical connection through umbilical cord 130, it is appreciated that, in certain other embodiments, such data and/or signals may be communicated wirelessly.

Onsite facility 170 and/or offsite controller 172 may be configured to provide instructions for boring operations (e.g., to chassis 110 and/or the boring elements thereof). Onsite facility 170 may be located within the general geographical vicinity of the job site, while offsite controller 172 may be located offsite. In certain embodiments, onsite facility 170 may include a controller and may communicate with offsite controller 172 via one or more data connections (e.g., Internet or other such connections). In various embodiments, one or both of onsite facility 170 and/or offsite controller 172 may not be present. In certain embodiments, chassis 110 may include its own controller 120. Variously, the controller(s) may provide instructions such as instructions for operation of the boring elements, chassis 110, and/or other portions of system 100. The controllers described herein may include one or a mixture of computing devices (e.g., computers) that allow for the determination of data and/or instructions.

In certain embodiments, offsite controller 172 may, additionally or alternatively, include additional facilities. Thus, for example, such offsite facilities may be configured to receive spoil samples from boring and may be configured to perform analysis of such spoil. For example, the offsite facilities may include an x-ray diffraction (XRD) analyzer, a laser induced breakdown spectroscopy (LIBS) analyzer, a laser induced fluorescence (LIF) analyzer, a Raman spectrometer, a mass spectrometer, a scanning electron microscope, an energy-dispersive x-ray spectroscopy, and/or an x-ray fluorescence analyzer, and/or any similar analytical technique to perform analysis of the spoil or similar geological feature.

Figure 1B:
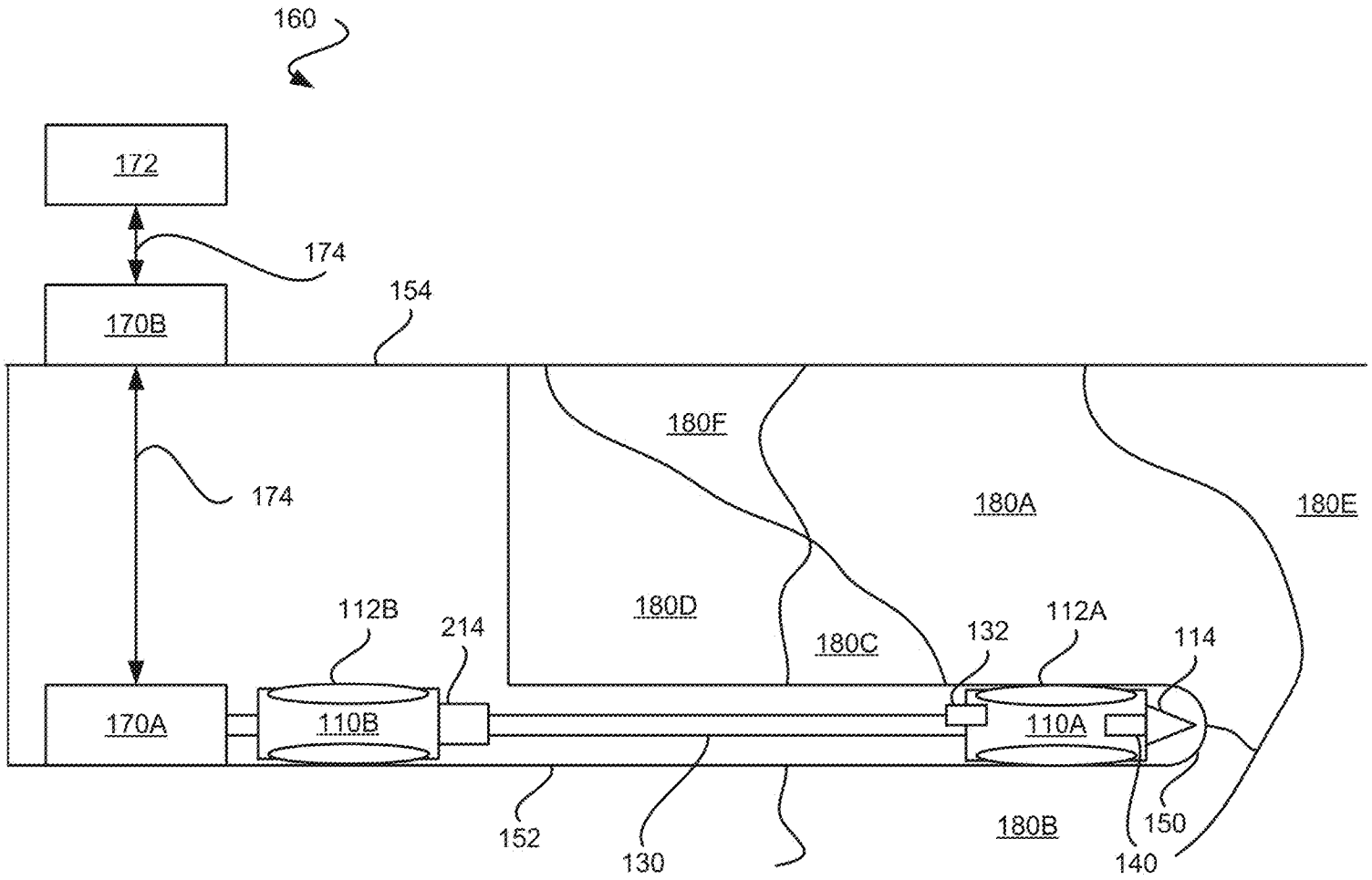
FIG. 1B illustrates a representation of another example boring situation, in accordance with certain embodiments.

In certain embodiments, onsite facility 170 may include various different auxiliary components of system 100. Thus, for example, onsite facility 170 may include components such as support vehicles (e.g., vacuum truck, water truck, fuel truck), spoil handling facilities, and/or analysis labs (e.g., for analysis of spoil to determine mineral composition, according to the techniques described herein). In various embodiments, onsite facility 170 may be located proximate to borehole 152, pit 154 (as shown in FIG. 1B), within pit 154, and/or within a distance away from the boring site.

The controllers may also be configured to receive data from various sensors of system 100. The controllers may utilize such data to determine conditions of borehole 152, such as conditions at bore face 150. For example, such data may allow for one or more controllers to generate a map (e.g., an optical map) of bore face 150 based upon an optical composition model determined from optical data from an optical sensor. The controllers may cause system 100 to adjust the operation of non-contact and/or contact boring elements currently in use (e.g., through adjustment of power output, stand-off distance, and/or other elements of non-contact boring elements and/or through adjustment of a boring speed of contact boring elements). The controllers may, additionally or alternatively, cause system 100 to transition between non-contact and contact boring elements, according to the techniques described herein, and may further control the targeting and/or aiming of non-contact boring element 114 and/or contact boring element 214, based upon the detected conditions.

The controllers may operate the boring elements during various phases of boring operations. Thus, one, some, or all of the controllers described herein may receive data, monitor sensors, measure parameters, determine states of the system, determine corrections, adapt to changes in the geology of the bore face 150, and/or transmit instructions and directions to one or more components (e.g., boring elements), subsystems, actuators, or sensors of system 100 in order to improve or optimize the performance of system 100 (e.g., boring rate or energy consumption) in an autonomous or substantially autonomous manner.

System 100 may be operated in formations with varying geological conditions. For example, in the example of FIG. 1A, system 100 may be operated in a mixed geological environment that includes geological regions 180A-F. Each such region may include different geological conditions, such as different types of rock, geological formations with varying hardness, abrasivity, intactness, soil types, different concentrations of ground water and/or void space, different geological types, and/or other such differences in conditions. In certain embodiments, operation of system 100 may be adjusted according to the techniques described herein.

In certain situations, bore face 150 may include a mix of geological regions, such as a mix of geological regions 180A and 180B, as illustrated herein. The systems and techniques described herein allow for the optimization of boring operations in such mixed conditions. Additionally, system 100 may bore through a plurality of different geological regions, such as geological regions 180A, 180B, 180C, 180D, and 180E (though not geological region 180F).

FIG. 1B illustrates a representation of another example boring situation, in accordance with certain embodiments. FIG. 1B illustrates system 160 that may be another boring scenario. In FIG. 1B, pit 154 may first be excavated (e.g., through conventional techniques). Thus, for example, pit 154 may be a shallow trench, a pit, a quarry, a shaft, and/or another such subterranean feature. For purposes of this disclosure, "pit 154" may be any type of subterranean feature that may allow for the housing of equipment and/or the launching of boring systems. Once pit 154 has been excavated, tools for boring, such as onsite facility 170A and various bore heads, may then be placed within pit 154. In certain embodiments, equipment, such as onsite facility 170B, may also be placed on the surface. System 160 may be accordingly set up through the digging of a trench (a.k.a. a pit, for the placement of certain boring equipment, which may be distinct from "trenching" as a tunneling technique) at the start of the borehole 152 and system 160 may then be placed within the trench (e.g., pit 154). Systems for operation of one or more boring elements (e.g., non-contact boring element 114) may then be accordingly coupled (e.g., fuel or air supplies may be coupled and provided via umbilical 130). Borehole 152 may then be bored with the various techniques described herein.

While illustrative reference is made herein to "borehole 152," the systems and techniques described herein may be utilized within boreholes, in drilling techniques, in pipes (e.g., carrier pipes), and/or in any other such supported or unsupported subterranean environments, such as mass excavation operations, mining, etc. It is appreciated that, for the purposes of this disclosure, "borehole" is used as an all-encompassing term and may refer to any such supported or unsupported subterranean environment. Furthermore, such subterranean environments may include varying cross- sectional dimensions (e.g., varying hole diameters and/or varying non-circular shapes, such as D-shaped boreholes with a flat bottom). Thus, for example, for pipe environments, the pipe type and/or diameter may vary.

In FIG. 1B, chassis 110A may include non-contact boring element 114 while chassis 110B may include contact boring element 214. In certain embodiments, a single chassis may house or support a single boring element. A non-contact or contact boring element may be selected and operated. Thus, in the example of FIG. 1B, chassis 110A with non-contact boring element 114A may be currently selected for boring operations (e.g., may be launched from pit 154 and may bore through the geological formation and, thus, create borehole 152). In certain embodiments, a determination may be made during boring operations that another boring element may be better suited for conditions. While certain embodiments may include a plurality of switchable boring elements on a single chassis, the embodiment shown in FIG. 1B may switch boring elements by removing chassis 110A from borehole 152 and inserting a chassis with the more suitable boring element (e.g., contact boring element 214 of chassis 110B). The more suitable boring element may then be operated (e.g., by onsite facility 170A/B and/or via umbilical 130, which it might be coupled to) until a further determination is made to switch boring elements.

Figure 1C:
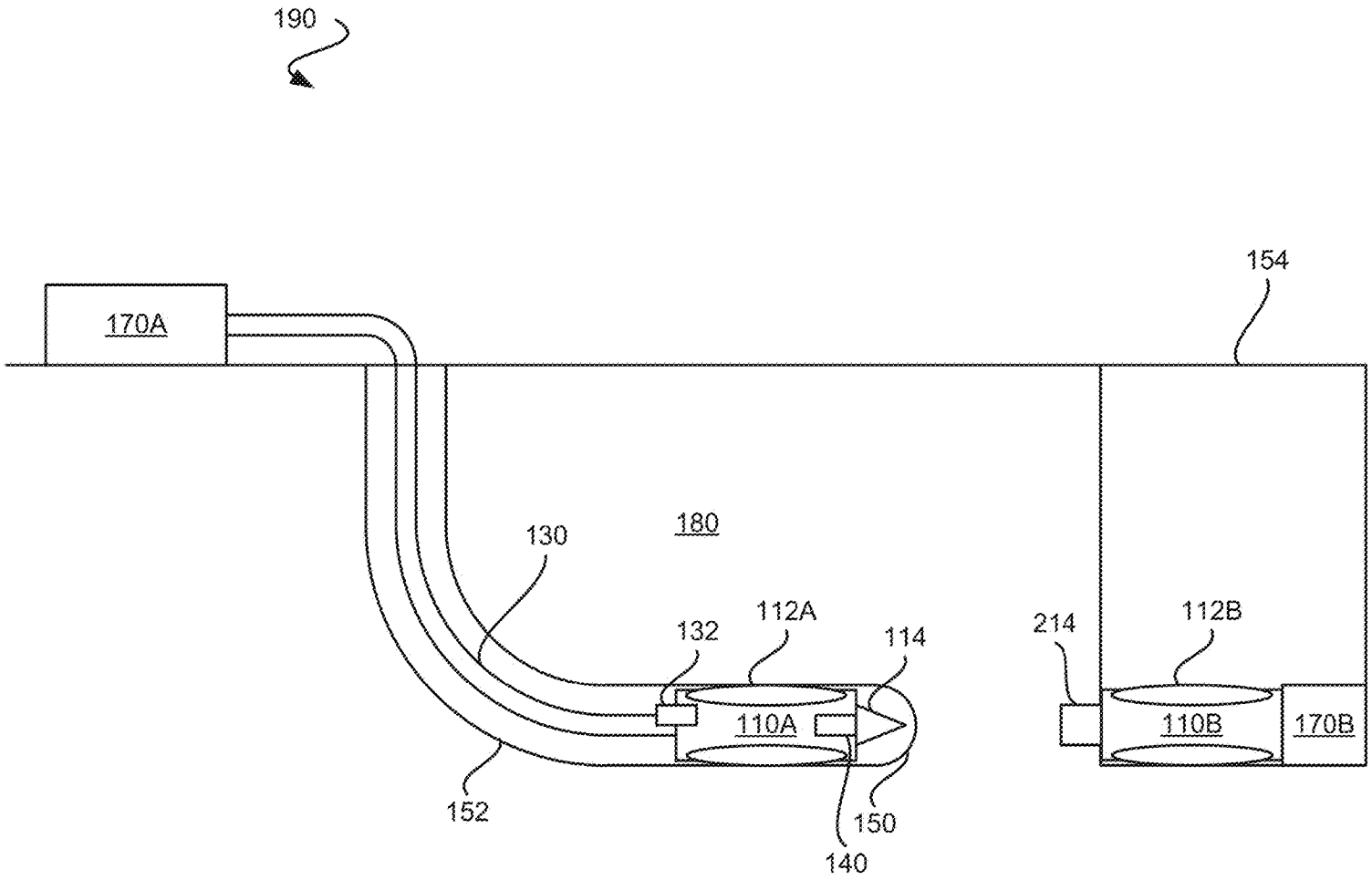
FIG. 1C illustrates a representation of a further example boring situation, in accordance with certain embodiments.

FIG. 1C illustrates a representation of a further example boring situation, in accordance with certain embodiments. FIG. 1C illustrates system 190 where chassis 110A may be boring through borehole 152 towards pit 154. In various embodiments, chassis 110A may be communicatively coupled to onsite facility 170A and/or onsite facility 170B, disposed within pit 154. Thus, in certain such embodiments, chassis 110A may be boring towards onsite facility 170B located within pit 154. In certain embodiments, one of onsite facilities 170A and 170B may be located elsewhere and/or may not be present.

Furthermore, in certain embodiments, onsite facility 170B may include its own associated bore head (e.g., associated with chassis 110B) which may be, for example, boring from pit 154 towards borehole 152. Such an operation may be a "meet in the middle" operation. In certain such operations, chassis 110A and 110B may approach each other and the final operations of completing the hole may be via a pipe welding/joining technique, such as from a pipe welding/joining robot.

In certain embodiments, the boring techniques described herein may include boring at an angle (e.g., at an angle different from horizontal). Thus, for the example of FIG. 1C, one or both of the boring operations illustrated could be boring at an angle (e.g., between 0 to 90 degrees from horizontal). For boring operations that includes a change in depth, the change in depth may cause a change in pressure. Operation of system 190 may be adjusted to adjust the mass flow needed to maintain positive conditions at the bore face(s). For example, in certain embodiments, the bore face may be maintained at approximately 1 atmosphere of pressure, with positive pressure flow out of the bore head and negative pressure at the evacuator of spoils, to minimize back pressure.

Figure 1D:
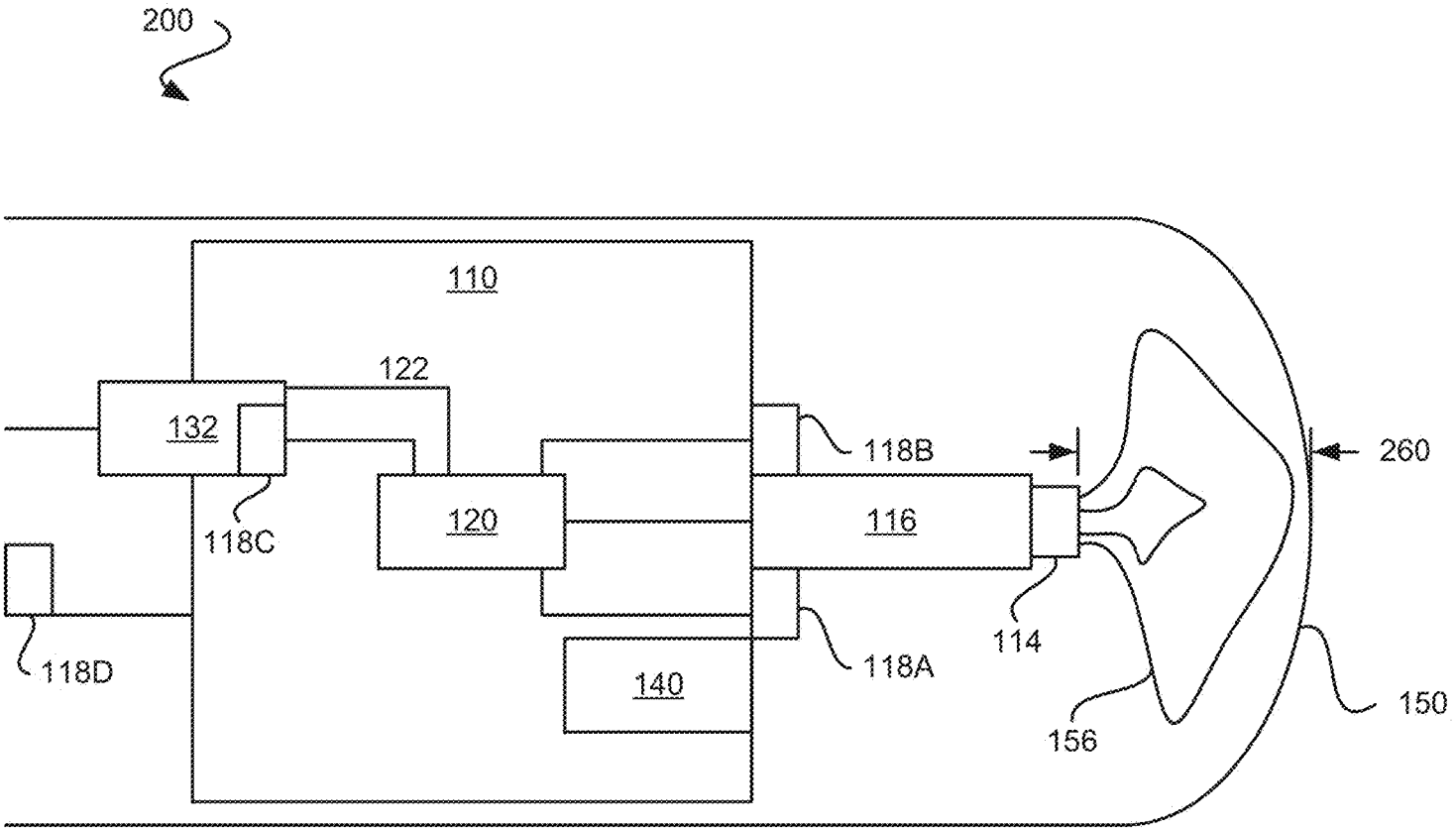
FIG. 1D illustrates a side view of an example non-contact bore head, in accordance with certain embodiments.

FIG. 1D illustrates a side view of an example non-contact bore head, in accordance with certain embodiments. FIG. 1D illustrates bore head 200 that includes chassis 110, non-contact boring positioning element 116, non-contact boring element 114, controller 120, spoil removal system 132, filtration or collection element 140, and sensors 118. Bore head 200 may be a boring machine that may freely move within boreholes and may be easily removable for ease of maintenance, repair, tool swapping, method swapping, and/or other such maintenance activities.

In various embodiments, a reference numeral may apply to a plurality of similar elements (e.g., sensors 118A-D), each denoted by different letters. Reference to just the number element itself may indicate that the description applies to elements that share the number reference.

Non-contact boring positioning element 116 of bore head 200 may be configured to locate non-contact boring element 114 relative to chassis 110. That is, non-contact boring positioning element 116 may advance and retract non-contact boring element 114 longitudinally, laterally, and/or vertically relative to chassis 110 as well as tilt non-contact boring element 114 in pitch and yaw on chassis 110 (e.g., by up to +/−30° or another such angle).

In certain embodiments, non-contact boring element 114 may be configured to provide boring through mass flow. Non-contact boring element 114 may, for example, be a fully-contained thermal cutterhead. Such a thermal cutterhead may be, for example, a Brayton-cycle turbojet engine configured to compress fresh air from an above-ground air supply within a compressor of the engine and configured to mix this compressed air with fuel from an above-ground fuel source, an afterburner or torch configured to receive fuel and air from an above-ground source, and/or another such thermal cutterhead. This fuel-air mixture may be combusted to provide energy to drive the compressor and exhausted to provide high temperature and high mass flow rate exhaust gases toward a face of an underground bore (e.g., bore face 150). These high temperature and high mass flow rate exhaust gases may reach bore face 150 within a jet impingement area, which may be an area of focus for non-contact boring. The exhaust gases may shock geologies at bore face 150, leading to spallation or other removal means of geologies and removal of rock spall from bore face 150.

Various sensors 118 may be configured to sense certain parameters of boring and allow for adjustment of certain aspects of boring. Sensors 118 may include, for example, a temperature sensor configured to output a signal representing the temperature of these exhaust gases. Controller 120 may be configured to receive such data signals and, in response, vary the fuel flow rate into the engine and/or adjust other boring parameters within the engine in order to maintain the temperature of these exhaust gases below the minimum melting temperature of all geologies present at the face (e.g., less than 1400° C. for certain geologies) or below the melting temperature of a particular geology detected at bore face 150 in order to maintain a high volume of rock removal per unit time and per unit energy consumed by the system 100. Controller 120 may include, for example, a processor and a memory and may be configured to receive data (e.g., operating or sensor data) and provide data (e.g., instructions) to the various components of system 100 and/or bore head 200 via communications interfaces 122. Communications interfaces 122 may be, for example, any wired and/or wireless communications technique that allows for the communication of data between components.

Sensors 118 may be, for example, a thermocouple, an air temperature sensor, a resistance temperature detector (RTD) sensor, a speed/torque sensor, a pressure transducer, a pressure sensor, an electrical output sensor, a flow rate sensor, a water pressure sensor, a water temperature sensor, a water electrical conductivity sensor, a spectropyrometer, a gas flow meter, a height sensor, a potentiometer, a clearance sensor, an accelerometer, a gyroscope, a tachometer or revolutions per minute (RPM) sensor, lidar, radar, a camera (e.g., a red-green-blue or RGB camera, hyperspectral camera, thermal camera, and/or another such camera), an acoustic sensor, a vibration sensor, a structured light sensor, and/or another such sensor. For certain embodiments, sensor 118A and/or 118B may be, for example, a camera, radar, lidar, and/or other such sensor and may be configured to determine stand-off distance 260 of non-contact boring element 114 from bore face 150. In another embodiment, sensor 118A and/or 118B may be configured to determine a power output of non-contact boring element 114 (e.g., to, for example, determine a temperature of exhaust and/or plasma outputted by non-contact boring element 114). Stand-off distance 260 may be a distance of inches or feet and stand-off distance 260 may first be implemented as a nominal stand-off distance (e.g., 6 inches) and then adjusted during operation. Stand-off distance 260 and/or power output may, for example, affect how flame front 156 of non-contact boring element 114 may perform during non-contact boring of bore face 150 (e.g., may adjust the intensity and size of the jet impingement area of flame front 156). Other sensor types may allow for the determination of other aspects of operation.

Stand-off distance 260 may be adjusted to control particle size distribution of spall resulting from non-contact boring. Particle size distribution of spall may be a function of stand-off distance 260, as well as other boring parameters described herein. Such other boring parameters may include, for example, the number and size of capillary tubes, the configuration of the flame holder of the afterburner, hole pattern of afterburner cooler, and/or air fuel mixture and may define the characteristic profile of the flame of the afterburner (e.g., in terms of temperature and/or mass flow). Adjustment of stand-off distance 260 and/or the other boring parameters may allow for tuning of the system in response to conditions at bore face 150 to optimize particle size distribution (e.g., for maximally efficient spoil evacuation).

Such a technique may be useful as, in non-contact boring, spoil particle size distribution may be within a wide range. The size range may include, for example, from dust to chips the size of fingernails to larger palm size chips and/or in other such geometries. The spoil may be wider in one dimension and, in certain situations, may be very thin (e.g., in the shape of a disc). Control of stand-off distance 260 allows for adjusting of the spoil that results from non-contact boring, allowing for optimal operating conditions, such as optimal evacuation of spoil from bore face 150.

By contrast, contact boring techniques tend to have spoil broken in large chunks and suspended in fluid. (Analysis of spoil in contact boring techniques typically requires post processing separation of the spoil from the fluid). If spoil is not suspended in fluid, then the spoil needs to be manually removed (e.g., with buckets).

Sensor 118A and/or 118B, as well as another sensor, may be, for example, a single depth sensor or a contact probe 192 configured to extend toward and retract from bore face 150. Such a sensor may determine (e.g., periodically, based on observed conditions, and/or via trigger commands provided by an operator) stand-off distance 260. Based on the measured stand-off distance 260, as well as other measured parameters, controller 120 may adjust a boring parameter (e.g., air flow, fuel flow, gas flow, electrical power) of non-contact boring element 114 to improve boring performance (e.g., by reducing the surface temperature at bore face 150 to improve spallation).

Non-limiting examples of various appropriate sensors are provided below:

| Sensor type | Location | Sensing metric |
|---|---|---|
| Thermocouple | General | Temperature measurements, including exhaust temperature measurements for non-contact boring element |
| Air temperature sensor | General | Stagnation temperature |
| RTD sensor | General | Temperature measurements, including exhaust temperature measurements for non-contact boring element |
| Speed/torque sensor | In engines and other rotational applications | Speed and torque of engine shafts/rods, gears, or blades (e.g., in a turbine). |
| Pressure transducer | Used for pressure measurement of low-temperature regions of engine (including uncombusted fuel/fuel line temperatures) | Pressure |
| Pressure sensor | Used for measuring internal pressures in an engine/turbine | Pressure |
| Electrical output sensor | Electrical power supply | Voltage, current, and power |
| Flow rate sensor | Within manifolds | Flow rate of gases and liquids |
| Water pressure and flow rate sensor | Water manifold | Pressure |
| Water temperature sensor | Water manifold | Temperature |
| Water electrical conductivity | Water manifold | Conductivity (e.g., as a proxy for dissolved solids) |
| Spectropyrometer | Laboratory (for plume temperature profiling in a controlled environment) | Thermal radiation at a wide variety of wavelengths to estimate a temperature and enthalpy |
| Gas flow meter | Gas valves | Flow rate of oxygen and of other combustive gas |
| Displacement sensor | General | Changes in the location of a physical point of contact (e.g., at the bore face) |
| Load cells | General | Force to determine physical contact |
| Absolute linear position sensor | General | Absolute positon of a physical point of contact along an axis of interest |

-continued

| Sensor type | Location | Sensing metric |
|---|---|---|
| Potentiometer | Acetylene torch cutterhead | Resistance across two leads |
| Clearance sensor | General | Amount of space from head to bore face |
| Accelerometer | General | Acceleration of chassis, for speed, distance traveled, acceleration (e.g., for advance rate) |
| Gyroscope | General | Orientation |
| RPM sensor | Motors | Rotational velocity |
| Lidar | General | Distance to objects or depth based on time of flight measurement for measuring of stand-off distance and/or distance to portions of a tunnel, such as distance off the ground |
| Camera | General | General (e.g., RGB) vision used to differentiate objects of different colors or textures, based on visible light, as well as identify the amount of distance traveled |
| Hyperspectral camera | General | Electromagnetic radiation in a wide variety of wavelengths with the purpose of identifying and distinguishing geologic features |
| Thermal camera | General | Thermal radiation to determine the temperature of objects |
| Radar | General | Distance to objects or depth based on time of flight measurement for measuring of stand-off distance and/or distance to portions of a tunnel, such as distance off the ground |
| Acoustic sensor | General | Acoustic signatures |
| Magnetometer | General | Orientation of magnetic fields |
| Vibration sensor | General | Sound waves, traveling through air or solids, which may indicate motion, machine performance, geological conditions, and/or other such conditions |
| Structured light sensor | General | Projects grid array and images to determine curvature/structure/distance/joint patterns for curved surfaces of tunnel face |

Non-contact boring element 114 may bore through geological formations via thermal spallation by directing a high-energy (e.g., high-temperature and/or high mass flow rate) stream of exhaust gases toward bore face 150. These exhaust gases rapidly transfer thermal energy into the surface of bore face 150, resulting in rapid thermal expansion of a thin layer at the surface of bore face 150. Expansion and local stresses may occur along natural discontinuities and nonuniformities that exist in the microstructure of the rock matrix of geological formations, causing differential expansion of the minerals of which the geological formation is composed thereof. The differential expansion may cause stresses and strains along and between mineral grains. Because geologies are typically brittle, rapid thermal expansion of the thin, hot surface layer at bore face 150 may cause the surface layer to fracture from the cooler geological formation (e.g., rock) behind bore face 150 and break into rock fragments (or spall) and separate from the surface of bore face 150 during this spallation process. The mechanism of fracturing or induction of micro-stresses at the surface of the bore face may vary across lithologies based on mineralogy, material properties, chemical properties, and physical properties of the surface subjected to these exhaust gases.

However, if the temperature of the exhaust gases reaching bore face 150 exceeds the melting temperature of the geological material at the surface of bore face 150, the surface of bore face 150 may melt rather than fracture and release from bore face 150. Certain non-contact boring techniques are configured to operate via spallation and, thus, such non-contact boring techniques may be operated to avoid the melting of bore face 150.

In certain embodiments, the engine may be, for example, a Brayton-cycle turbojet engine with its outlet nozzle facing toward bore face 150. The engine may be configured to generate high-temperature exhaust gases and to direct these exhaust gases at a high mass flow rate in order to maintain a high pressure and a high total heat flux at bore face 150 and to achieve rapid spallation and material removal from bore face 150. In various embodiments, the various controllers described herein may implement closed-loop controls to maintain the temperature of the exhaust gases to below that of the melting temperature of all geologies (e.g., 825° C. to compensate for melting temperatures between 900° C. and 1400° C. for most geologies) or below the melting temperature of a particular geology detected at bore face 150. The engine may also maintain a high mass flow rate in order to compensate for the sub-melting temperature exhaust temperatures in order to generate high heat flux at bore face 150 and, therefore, a high rate of spallation at bore face 150.

In certain embodiments, the engine for non-contact boring element 114 may include a combustor that burns fuels, a turbine that transforms pressure and thermal energy of gases exiting the combustor into mechanical rotation of a driveshaft, and an integrated axial compressor that is powered by the turbine via the driveshaft to draw air into the engine, to compress air, and to feed air into the combustor. An air supply (e.g., from onsite facility 170) may provide aboveground air to the engine and a fuel supply may provide fuel to the engine from an above ground supply (e.g., a fuel tank). Onsite facility 170 may monitor the air and fuel provided to the engine, as well as the completeness of combustion and other operating aspects.

Example Mass Flow Configurations

Figure 2:
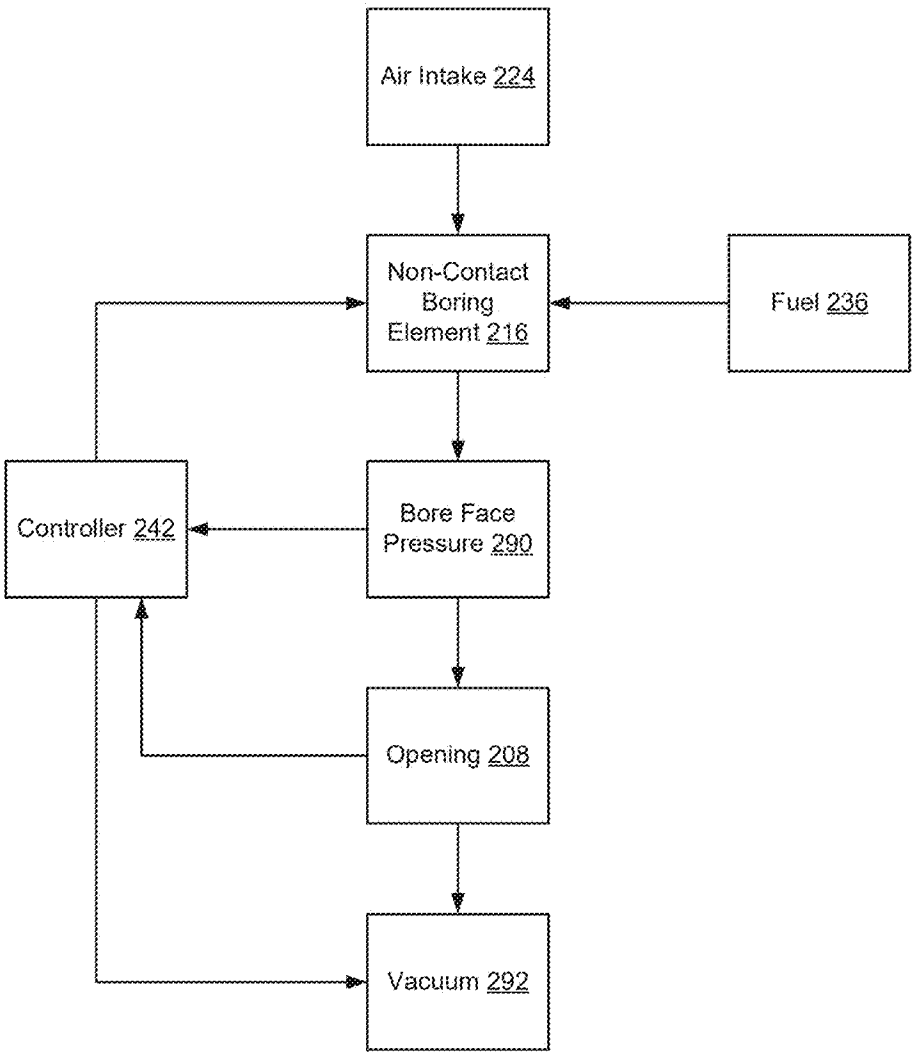
FIG. 2 is a flowchart illustrating mass and data flow through an example system, in accordance with certain embodiments.

FIG. 2 is a flowchart illustrating mass and data flow through an example system, in accordance with certain embodiments. The various aspects of FIG. 2 may be sensed by sensors as described herein.

Air intake 224 may be an intake configured to receive air for non-contacting boring element 216 (e.g., for combustion or other purposes). Additionally, fuel 236 may provide fuel for, e.g., combustion created by non-contact boring element 216. Non-contact boring element 216 may be powered by air and fuel from 224 and 236. Air and fuel may, thus, compose part or all of the flow of mass through non-contact boring element 216.

Non-contact boring element 216 may be configured to perform thermal spallation techniques on a bore face, as described herein. Bore face pressure 290 may be the pressure generated by combustion performed by non-contact boring element 216. Bore face pressure 290 may be used to aid in the performance thermal spallation. In various embodiments, bore face pressure 290 may be detected by one or more sensors and such sensor readings may be communicated to controller 242. Controller 242 may be any type of controller described herein.

Opening 208 may be an opening (e.g., within a conical head) configured to remove spoil from the bore face (e.g., spoil generated by thermal spallation). The spoil may be removed through opening 208 by a vacuum generated by vacuum 292. In various embodiments, opening 208 (and/or vacuum 292) may include one or more sensors configured to determine the amount of vacuum generated and provide such data to controller 242.

Controller 242 may be configured to receive such data and provide adjustments to the operation of non-contact boring element 216 and/or vacuum 292. Thus, for example, controller 242 may be configured to avoid conditions that result in back pressure on non-contact boring element 216.

Thus, for example, controller 242 may determine whether vacuum 292 is greater than or equal to bore face pressure 290. If vacuum 292 is greater than or equal to bore face pressure 290, operation may be continued. In certain embodiments, such as if vacuum 292 is greater than bore face pressure by a threshold amount, operation of non-contact boring element 216 and/or vacuum 292 may be adjusted to decrease the difference (e.g., by increasing bore face pressure 290 through providing greater mass flow through non-contact boring element 216 and/or by reducing the amount of vacuum generated). If vacuum 292 is less than bore face pressure 290, operation may be adjusted to request in vacuum 292 being greater than or equal to bore face pressure 290. Thus, for example, operation of non-contact boring element 216 may be adjusted by increasing bore face pressure 290 through providing greater mass flow through non-contact boring element 216 and/or the operation of vacuum 292 may be adjusted by reducing the amount of vacuum generated.

In other embodiments, bore face pressure 290 by itself may allow for a determination of whether non-contact boring element 216 is experiencing back pressure. For example, back pressure at the exhaust of non-contact boring element 216 may be determined by a pressure sensor (e.g., indicating a direction of pressure) and such a sensor reading may allow for a determination of back pressure. If back pressure is detected, operation of non-contact boring element 216 may be adjusted by decreasing the mass flow through non-contact boring element 216 and/or the operation of vacuum 292 may be adjusted by increasing the amount of vacuum generated. Otherwise, if no back pressure is detected, operation may be continued or, if reduction of the positive pressure difference is determined to be advantageous for operation of the system, mass flow through non-contact boring element 216 may be increased and/or the operation of vacuum 292 may be decreased.

Figure 3A:
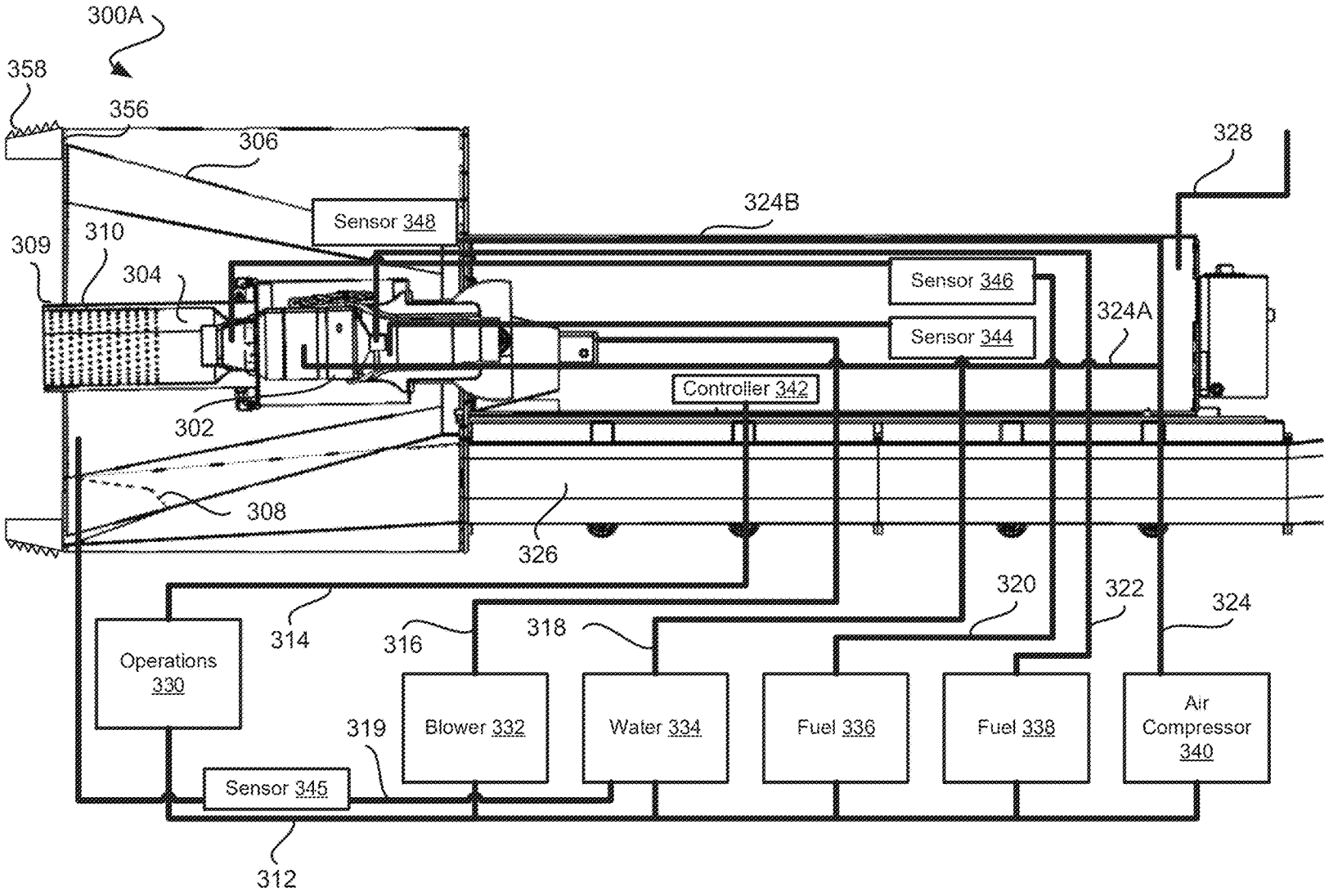
FIG. 3A illustrates a side view of an example non-contact boring system, in accordance with certain embodiments.

FIG. 3A illustrates a side view of an example non-contact boring system, in accordance with certain embodiments. FIG. 3A illustrates system 300A includes portions disposed within the borehole as well as portions disposed outside of the borehole. Portions disposed within the borehole include turbine 302, afterburner 304, conical system head 306 with spoil removal opening 308, head crown 356, controller 342, and various sensors. Portions disposed outside of the borehole include operations 330, blower 332, water reservoir 334, fuel tank 336, fuel tank 338, and air compressor 340. Various circuitry, including data circuitry (configured to communicate signals and data) as well as mass flow circuitry (configured to allow the flow of mass, such as air or liquids) may couple together portions of system 300A.

Turbine 302 may be a type of turbine as described herein. Turbine 302 may be utilized to perform thermal spallation techniques. Operation of turbine 302 may require a continuous flow of oxygen, which may be provided from outside of the borehole. For example, ambient air path 328 may communicate airflow into the downhole portions of system 300A (e.g., chassis 110 as described herein), and such airflow may be utilized during operation of turbine 302. Furthermore, blower 332, which may be any type of fan or blower (e.g., centrifugal blower) may also provide airflow to the downhole portions of system 300A, and turbine 302 may utilize such airflow from blower 332.

Airflow produced by blower 332 may be communicated via airflow circuit 316. Airflow circuit 316 may be any type of flow path, such as a duct, that may allow for airflow generated by blower 332 to pass to its destination, such as turbine 302 and other portions of system 300A. In certain embodiments, blower 332 may be configured to produce high volume airflow for system 300A while other air sources (e.g., ambient air path 328 and/or air compressor 340) may produce lower volume airflow. The high volume airflow may allow for operation of turbine 302. Variously, airflow from airflow circuit 316 may be utilized for additional purposes before powering turbine 302, such as a cooling the electronics of controller 342.

Afterburner 304 may be disposed on an end of turbine 302. Afterburner 304 may be an afterburner that injects fuel to combust excess air flowing from turbine 302. Thus, afterburner 304 may also utilize the airflow produced by blower 332. In certain embodiments, afterburner 304 may produce additional thrust and/or heat that may be utilized for thermal spallation.

The systems described herein, such as system 300A, utilize turbine 302 and/or afterburner 304 in a manner different from that of a normal turbine. Turbines normally operate in free space and not in a constricted environment (e.g., boreholes, mines, drifts in mines, tunnels, etc.) as in system 300A. Such constricted environments may constrict airflow, leading to concentrated temperatures and high pressure. The high pressure may cause pressure that picks up and causes particulates, water, steam, and other matters to enter turbine 302.

Accordingly, system 300A includes air intake components for turbine 302 and/or afterburner 304, as well as active (e.g., blower 332 and/or air compressor 340, which may deliver additional cooling air) and passive (e.g., afterburner openings 310 within afterburner shroud 309) cooling elements to lower the heat buildup and elements such as spoil removal opening 308 of conical system head 306 to evacuate spoil and reduce pressure/generate vacuum.

In certain embodiments, afterburner shroud 309 may include one or more water circuits that provide for liquid cooling of afterburner shroud 309 (e.g., from one of more water sources described herein). In certain embodiments, exhaust from thermal cutterhead (e.g., from the combustor) may be of a high enough temperature that spallation may occur proximate to the exhaust due to the high temperatures. Cooling of portions of afterburner shroud 309 as well as other portions of the exhaust of the thermal cutterhead may thus be performed to lower the temperature around the portions of the thermal cutterhead where thermal spallation is not desired and, thus, to prevent unintended thermal spallation around such portions due to exhaust temperature.

In general, thermal management of the entire system, especially the areas of the system that attains high temperatures, such as the exhaust, may be performed to prevent unintended spallation and, thus over-boring. Such thermal management may be via air, water, and/or other coolant provided via one or more circuits. One or more such thermal management techniques may be utilized for each portion. Thus, certain portions may utilize both liquid and air cooling or have the options to do so. Certain embodiments may include circuits dedicated towards providing cooling to certain portions of the system that may be known to highly effect the performance of thermal spallation, such as the cooling shroud around the exhaust of the combuster (e.g., afterburner, turbine, torch, rocket, or other combuster). Due to the importance of cooling mediums in controlling the temperature of the system to perform spallation, the cooling medium reservoir levels (e.g., water levels) may be carefully maintained.

In general, if system overheats, or if thermal management is not closely controlled, over-boring can occur. For example, active cooling of the casing allows for better control of down hole temperatures, resulting in better control of the boring profile at the bore face. Another technique involves using cooled fresh air from a blower. They can be used in conjunction to achieve the desired result.

Conical system head 306 may be a conical head disposed on an end of system 300A. In various embodiments, conical system head 306 may partially or fully shroud one or both of turbine 302 and afterburner 304. Conical system head 306 may be configured to be disposed proximate to a bore face of the borehole. Conical system head 306 may be configured to effect the airflow from turbine 302 and/or afterburner 304 in a manner that causes airflow conditions on the bore face to recirculate. Such airflow conditions may cause spoil to circulate within the airflow and may produce conditions similar to liquification of the spoil. The spoil may then be more easily evacuated via spoil removal opening 308 of conical system head 306. Furthermore, such circulation of spoil may prevent build-up of spoil on the various downhole portions of system 300A, such as the various sensors, turbine 302, afterburner 304, and/or other areas of system 300A. Thus, for example, without the airflow caused by conical system head 306, spoil may collect in various parts of system 300A and affect operation of system 300A.

Conical system head 306 may be shaped in certain geometries/shapes. The geometry or shape of conical system head 306 may affect where the spoil collects or flows through and, thus, control where within conical system head 306 the spoils travels to within conical system head 306. Furthermore, the geometry or shape of conical system head 306 may affect the mass flow through the system (e.g., effect the volume of mass that flows through the system). Thus, the geometry or shape of conical system head 306 may affect the flow of spoil into spoil removal opening 308.

Spoil removal opening 308 may be an opening within conical system head 306. A vacuum may be generated within spoil removal opening 308 (e.g., by vacuum 398) to suck out spoil from the bore face. Spoil that passes through spoil removal opening 308 may be removed via spoil removal path 326. Spoil removal path 326 may communicate spoil outside of the borehole, according to the configurations described herein. Spoil within the systems described herein may be dry (e.g., not a slurry) or may have liquid, such as water or steam, added to the spoil for removal. Various embodiments of spoil removal path 326 may include one or more sensors, such as air flow sensors, temperature sensors, and/or other such sensors described herein.

Vacuum 398 may be any type of component configured to generate vacuum and may be located on the chassis within the borehole or outside of the borehole (e.g., in an onsite facility or a vacuum truck). Vacuum 398 may be fluidically coupled to spoil removal opening 308 (e.g., by, for example, piping).

In certain embodiments, vacuum 398 may be configured to generate a greater amount of vacuum than the total mass flow of the system would require. Though total mass flow through system 300 will necessarily be balanced in terms of incoming and outgoing mass (e.g., as defined by mass being provided into the bore face shortly after spallation and by mass exiting the system via vacuum 398 and other exit sources) over a long steady state period, vacuum 398 may be overdriven to provide transient vacuums based on detected conditions to, for example, affect operation of the combustion characteristics of a combuster.

Conical system head 306 may include sensor 348, which may be mechanically and/or communicatively coupled to conical system head 306. Variously, sensor 348 may be, a LIDAR, radar, or visual sensor configured to determine conditions of a bore face. Alternatively or additionally, sensor 348 may be a displacement sensor (e.g., accelerometer, strain gauge, and/or other such sensor configured to detect movement) configured to detect movement of conical system head 306 indicating impacts of conical system head 306 with the bore, bore face, and/or overcut of the bore. Thus, sensor 348 allows for conical system head 306 to act as a diametric sensor, informing the condition of boring operations and adjustment of operations thereof. Thus, for example, if sensor 348 detects contact of conical system head 306, operation of system 300A may be adjusted (e.g., the direction of non-contact boring may be changed and/or other boring techniques may be utilized to eliminate the contact).

Head crown 356 may be disposed in front of the outer perimeter of conical system head 306. Head crown 356 may be configured to protect conical system head 306 and/or other components of system 300A from loads. Head crown 356 may include teeth 358. Additionally or alternatively, conical system head 306 may also include one or more such teeth. In certain embodiments, teeth 358 may be, for example, tungsten teeth or teeth from another material. In certain embodiments, head crown 356 may include one or more sensors (e.g., load cells) to allow for detection of contact between head crown 356 and the bore casing and/or tunnel according to the techniques described herein.

In certain embodiments, head crown 356 may be utilized for boring operations, such as finalization of the bore shape through contact with teeth 358. Additionally or alternatively, head crown 356 may be configured to rotate to allow for boring, reaming, and/or ramming with head crown 356 and/or teeth 358.

In various embodiments, head crown 356 may be cooled via one of more techniques described herein, such as via cooling air and/or water from the elements described herein. In certain such embodiments, a chamfer weld may be provided between conical system head 306 and head crown 356 to decrease resistance when system 300A is being withdrawn from the borehole.

Operations 330 may be an onsite facility (e.g., onsite facility 170) or an offsite facility (e.g., offsite controller 172) that may provide instructions for operation of system 300A. Operations 330 may be communicatively coupled to various portions of system 300A via communication circuitry (e.g., communications circuitry 312 and communications circuitry 314). Such communications circuitry may be configured to transmit and receive signals and data, as described herein. For example, operations 330 may be communicatively coupled to portions of system 300A disposed outside of the borehole (e.g., blower 332, water reservoir 334, fuel tank 336, fuel tank 338, and/or air compressor 340) via communications circuitry 312. Operations 330 may be communicatively coupled to portions of system 300A disposed outside of the borehole (e.g., controller 342, which may control operation of the chassis within the borehole) via communications circuitry 314.

In certain embodiments, operations 330 may include power generation for powering the operations of system 300A. Such power generation may be, for example, via diesel generator, biodiesel generator, gasoline generator, solar panels, wind, connection to the power grid, and/or through other such techniques for providing power. Thus, for example, operations 330 may be powered by the electrical grid where available and by generators and/or other power sources if needed (e.g., if no electrical grid is available and/or for power surge requirements).

Furthermore, in various embodiments, the hydraulic flows for system 300A may be operated in different configurations (e.g., high thrust, low speed, high retract speed, lack of pushing force, etc.). The different hydraulic flows allow for the various configurations of operation of the various components of system 300A.

Controller 342 may be configured to control operation of portions of system 300A (e.g., the chassis within the borehole, which may include turbine 302, afterburner 304, conical system head 306, and various sensors, as shown in FIG. 3A). Controller 342 may be type of controller described herein and may be communicatively coupled with various systems of system 300A, such as operations 330 and the portions of system 300A that controller 342 is configured to provide instructions to.

In various embodiments, controller 342 may be configured to modulate boring operations in relation to detected mass flow of system 300A. For example, in a certain embodiment, non-contact boring operations may be operated in a first boring state with first mass flow parameters. Thus, the non-contact boring system (e.g., turbine 302 and/or afterburner 304) is operated in the first boring state to drive thermal spallation and thus excavation at the bore face. The thermal spallation produces a certain volume of spoil at a certain rate. The spoil removal systems of system 300A (e.g., conical system bend 306 and spoil removal opening 308) may be operated at a vacuum to evacuate spoil at an evacuation rate, which may substantially (e.g., +/−0 to 50%) match the production rate of spoil. Accordingly, mass balance between excavation (e.g., spoil creation) and evacuation may be substantially achieved. Such mass balance may correlate to forward penetration rate and, thus, the production rate of boring. If the excavation rate is greater than the evacuation rate of spoil, then pressure will build up at the bore face, resulting in back pressure Sensors (e.g., the sensors described herein or additional sensors configured to sense mass flow through certain portions of system 300A) may provide data to controller 342 to indicate mass flow within various portions of system 300A. Controller 342 may adjust operation of system 300A based on such sensor readings by, for example, adjusting the rate of spoil creation and/or evacuate, adjusting the rate of pressure created by turbine 302 and/or afterburner 304 as well as vacuum created by spoil removal opening 308, and/or adjusting other parameters to drive ideal mass flow (e.g., in order maintain stability of the cutterhead).

In certain situations (e.g., in mixed face and/or mixed boring situations, and/or where spoil may include particles of varying size, weight, hardness, abrasiveness, saturation, etc.), controller 342 may determine that data from sensors indicate a situation impossible to maintain sufficient mass flow (e.g., positive pressure at the bore face and negative pressure at the spoil removal system). Based on such a determination, controller 342 may switch to a contact boring technique. Such a situation may, for example, be present due to certain levels of ground pressure, the presence of water, the presence of underground gasses, and/or other such geological conditions (e.g., as described herein).

Water reservoir 334 may be configured to provide water to certain portions of system 300A (e.g., for cooling of turbine 302, afterburner 304, and/or other portions of system 300A) via one or more liquid circuits, such as liquid circuits 318 and 319. In certain embodiments, water reservoir 334, liquid circuit 319, and/or liquid circuit 318 may include one or more water pumps that may pump water into various portions of system 300A, such as into the borehole, the bore face, the afterburner, the turbine, the casing, or locations proximate to the afterburner (e.g., via spray cooling atomizers).

Liquid circuits 318 and/or 319 may include a water manifold for distributing the water and water pressure sensors 344 and/or 345, respectively, to determine whether sufficient water pressure is being delivered. In certain embodiments, water from water reservoir 334 may be communicated via liquid circuit 318 to portions of turbine 302 and/or afterburner 304. Detection of inappropriate water pressure may, for example, cause controller 342 to cease operation of turbine 302, afterburner 304, and/or boring operations entirely.

In certain embodiments, water reservoir 334 may provide water for a water spray at the bore face via liquid circuit 319. The water spray may be atomized at the bore face and reduce the temperature of exhaust gases from turbine 302 and/or afterburner 304. Accordingly, in certain embodiments, water from liquid circuit 318 may provide cooling to the thermal cutterhead (e.g., turbine 302 and/or afterburner 304) while water from liquid circuit 319 may provide cooling for the bore face and/or for exhaust generated by the thermal cutterhead. Steam may be produced from the water spray and may lead to volumetric expansion at the bore face. The vacuum from conical system head 306 may produce negative pressure to evacuate such steam and prevent back pressure at turbine 302 and/or afterburner 304.

Fuel tank 336 may be fuel configured to power afterburner 304. Such fuel may include, for example, jet fuel, diesel, kerosene, and/or another appropriate fuel. In certain embodiments, fuel tank 336 and/or fuel circuit 320 may include a pump for the delivery of fuel and/or a filter for removing impurities. Fuel circuit 320 may communicate fuel from fuel tank 336. Fuel circuit 320 may include a fuel pressure sensor 346 to determine whether there is appropriate fuel pressure to operate afterburner 304. Detection of inappropriate fuel pressure may, for example, cause controller 342 to cease operation of afterburner 304. Fuel from fuel circuit 320 may be delivered via, for example, capillary fuel manifolds into afterburner 304.

Fuel tank 338 may include fuel configured to be delivered to turbine 302. Such fuel may include any type of appropriate fuel, including jet fuel, diesel, kerosene, and/or another such appropriate fuel. Fuel from fuel tank 338 may be delivered via fuel circuit 322. In certain embodiments, fuel tank 338 and/or fuel circuit 322 may include a pump for delivery of fuel and/or lubrication (e.g., certain types of fuel may require lubrication, such as premix oil, with the fuel) and/or a filter for removing impurities. Certain embodiments may include one or a plurality of fuel lines within fuel circuit 322 (e.g., for redundancy reasons).

Figure 3B:
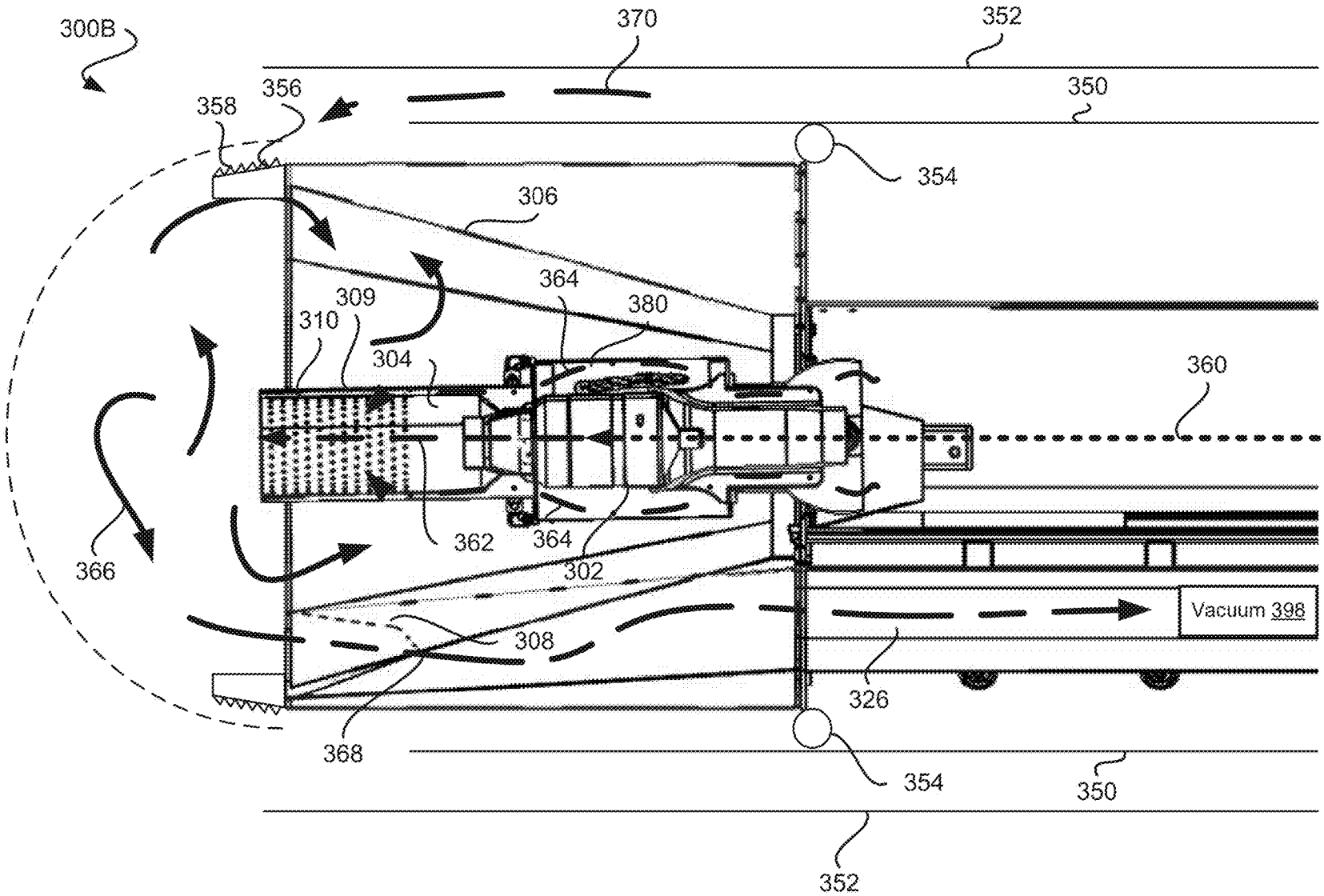
FIG. 3B illustrates a side view of a mass flow configuration of an example non-contact boring system, in accordance with certain embodiments.

Air compressor 340 may be configured to deliver compressed air to various portions of system 300A (e.g., via air circuit 324). Such compressed air may be utilized to clean various components of system 300A, such as cleaning controller 342, the various sensors thereof (e.g., the lens of a LIDAR, radar, or sensor 348), the various fuel circuits, and/or other such components of system 300A (e.g., through air circuits 324A or 324B, which may be air circuits that split off of air circuit 324). Furthermore, air compressor 340 may be configured to provide air to afterburner 304 to, for example, provide compressed air start to ease the lighting and/or relighting of afterburner 304. FIG. 3B illustrates a side view of a mass flow configuration of an example non-contact boring system, in accordance with certain embodiments. FIG. 3B illustrates system 300B, which may highlight the various mass flow paths of system 300B. System 300B may include similar components to system 300A.

Airflow 360 may provide airflow for operation of turbine 302. Thus, airflow 360 may provide oxygen to the compressors, turbines, and/or other components of turbine 302. Airflow 360 may be provided by a blower, compressor, ambient air outside of the borehole, and/or other source.

Airflow 360 may pass through turbine 302 and enter afterburner 304 as afterburner flow 362. Afterburner flow 362 may, thus, include air that has been utilized by turbine 302 (e.g., a portion of the oxygen has already been combusted). Fuel may be injected into afterburner flow 362 to operate afterburner 304.

Turbine bypass 380 may bypass turbine 302 and provide cooling airflow to the exhaust of afterburner 304. In various embodiments, afterburner 304 may need to be operated within a certain temperature range to perform appropriate thermal spallation. For example, if the afterburner exhaust temperature is too low, thermal spallation is not performed. However, if the temperature is too high, the geology may be melted instead of spalled. Turbine bypass 380 may provide the appropriate cooling airflow to the exhaust of afterburner 304 (e.g., afterburner flow 362) so that the exhaust temperature is in the appropriate range (e.g., between 1,000 to 1,500 Celsius).

In various embodiments, airflow 360 and turbine bypass 380 may be provided by any appropriate source, such as blowers, compressors, and/or ambient air. The volume of airflow 360 and/or turbine bypass 380 may be controlled by the components providing the airflow and/or by one or more controllers (e.g., by varying the restriction within a flow path through, for example, opening or closing of bypass doors).

Afterburner 304 may be configured such that afterburner flow 362 may exit afterburner 304 and enter the area in front of the bore face. Afterburner flow 362 may, thus, generate spoil flow 366 within the area in front of the bore face. Additionally or alternatively, spoil flow 366 may be generated by airflow from blower 332 and/or air compressor 340. Thus, for example, blower 332 and/or air compressor 340 may include an air circuit that provides airflow to a location proximate the bore face and generate spoil flow 366. Spoil flow 366 may be airflow that may pick up spoil resulting from thermal spallation.

In certain embodiments, spoil flow 366 may be amplified by conical system head 306. Conical system head 306 may be a cone shaped shroud disposed around turbine 302 and/or afterburner 304 or portions thereof. Conical system head 306 may be configured to cause spoil flow 366 to recirculate and/or accelerate spoil flow 366. Spoil flow 366 may then cause spoil to become airborne within the airflow of spoil flow 366 and, in certain embodiments, may cause the spoil to circulate within spoil flow 366 in a manner similar to that of a liquid. In various embodiments, positive pressure from turbine 302 and/or afterburner 304 and negative pressure from spoil removal opening 308, along with the turbulence of spoil flow 366, causes spoil to be suspended within airflow and flowing (e.g., for evacuation), even when wet.

Spoil within spoil flow 366 may be evacuated from the bore face via spoil removal opening 308. Spoil removal opening 308 may be an opening within a portion of conical system head 306, such as within the bottom half, third, quarter, or other portion of conical system head 306. Spoil removal opening 308 may generate a vacuum that may be utilized to remove spoil and/or prevent back pressure on turbine 302 and/or afterburner 304. Spoil flow 368 may enter spoil removal opening 308 and be evacuated from the bore face and the borehole via spoil removal path 326. Spoil removal path 326 may, for example, include a suction that may remove spoil from the bore face and/or borehole to outside of the borehole.

In various embodiments, suction generated by spoil flow 366, spoil flow 368, and/or spoil removal path 326 may provide further borehole sealing, preventing spoil from interfering with operation of portions of system 300B and/or from building up within portions of the borehole. Thus, for example, such suction may cause airflow 370 to flow towards the bore face. Airflow 370 may be air flow between casing 350 and tunnel 352. In certain embodiments, boring operations may cause tunnel 352 to be bored and casing 350 to be deposited as part of boring operations. Airflow 370 may prevent spoil from being disposed between casing 350 and tunnel 352.

In certain embodiments, seal 354 may be disposed between casing 350 and the chassis. Seal 354 may prevent leakage of airflow between portions of system 300B and casing 350, preventing spoil from leaking into undesired areas.

Figure 3C:
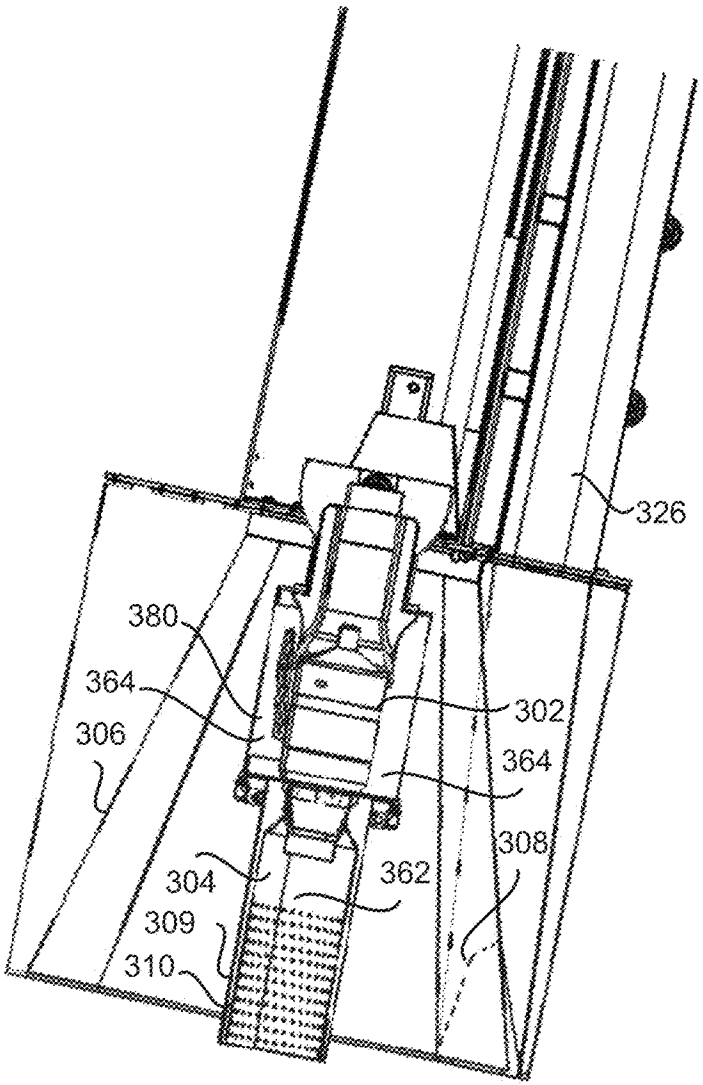
FIG. 3C illustrates another side view of an example non-contact boring system, in accordance with certain embodiments.

FIG. 3C illustrates another side view of an example non-contact boring system, in accordance with certain embodiments. FIG. 3C illustrates system 300C, which may be similar to system 300A, but operated at a non-horizontal orientation.

In certain embodiments, system 300A may be configured to operate at non-horizontal orientations. In certain such embodiments, system 300A may be, for example, configured to be operated at downward (up to vertical) orientation wherein the opening of conical system head 306 is downward. In other embodiments, system 300A may be operated at an upward orientation. Operation at such orientations may affect mass flow. For example, in the downward orientation of system 300C as shown in FIG. 3C, gravity may cause spoils to move downward. As spoil removal opening 308 may be above where spoils are generated, gravity needs to be overcome in order to evacuate the spoils. In various embodiments, a controller of system 300C may detect the orientation (e.g., operational angle via, for example, one or more accelerometers, gyroscopes, and/or other such sensors) of system 300C and adjust the operation of system 300C. For example, the vacuum generated through spoil removal opening 308 may be increased and/or the mass flow through turbine 302 and/or afterburner 304 may be decreased when system 300C is in the orientation shown in FIG. 3C. Conversely, when system 300A is operated at an upward orientation, the vacuum generated throughspoil removal opening 308 may be decreased and/or the mass flow through turbine 302 and/or afterburner 304 may be increased. Other adjustments, such as to the stand-off distance and other such adjustments described herein, may be alternatively or additionally performed.

Figure 3D:
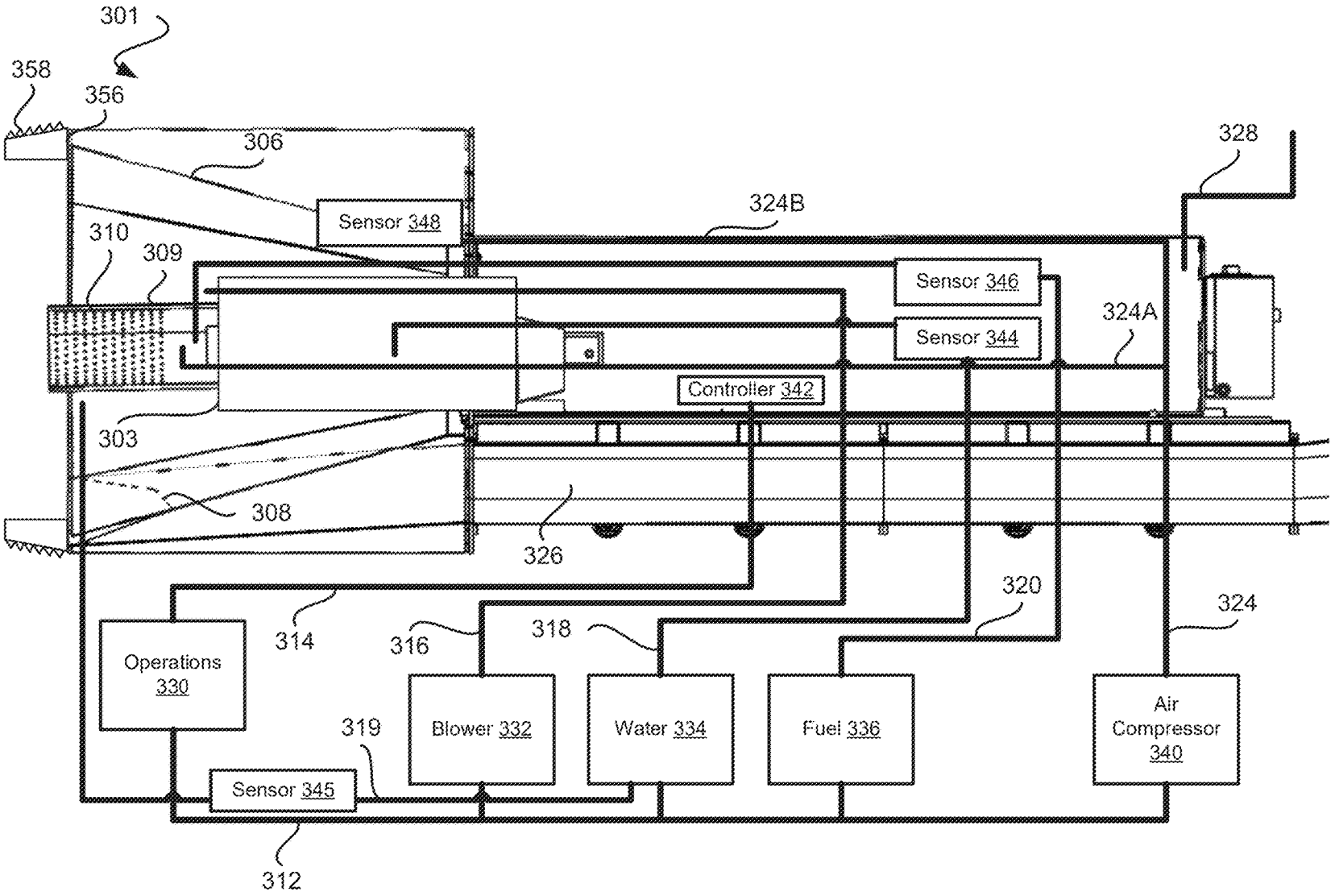
FIG. 3D illustrates a side view of another example non-contact boring system, in accordance with certain embodiments.

FIG. 3D illustrates a side view of another example non-contact boring system, in accordance with certain embodiments. FIG. 3D illustrates system 301 that includes turbine-less thermal cutterhead 303. In the embodiment of FIG. 3D, turbine-less thermal cutterhead 303 may be utilized as an alternative to turbine 302 and/or afterburner 304. Turbine-less thermal cutterhead 303 may be a torch, an air-breathing rocket, and/or another source of heat and thrust for boring that does not include a turbine. Thus, for example, turbine-less thermal cutterhead 303 may, in certain embodiments, operate similarly to afterburner 304 or a torch, where air is provided at the exit of a fuelflow circuit, or fuel is provided at the exit of an airflow circuit to cause combustion. In various other embodiments, such sources may be via a turbine, a turbine and afterburner (e.g., the embodiment of FIGS. 3A-C), and/or turbine-less (e.g., the embodiment of FIG. 3D).

In certain embodiments, heat and thrust may be utilized to perform techniques such as the spallation techniques described herein. Embodiments utilizing turbine-less thermal cutterhead 303 may only utilize one fuel source (e.g., fuel tank 336) and one air source (e.g., air compressor 340) as only one source of heat and thrust (the thermal cutterhead) may be present in such a system. Other embodiments may utilize a plurality of fuel and/or air sources (e.g., blower 332, as shown in FIG. 3D). Such embodiments may, for example, include a first air source directed for combustion and a second air source for spoil removal. In certain embodiments, the rate of air and fuel flow from fuel tank 336 and air compressor 340 may be different in the embodiment of FIG. 3D than that of other embodiments described herein, due to differences in fuel and air consumption of turbine-less thermal cutterhead 303 compared to that of turbine 302 and afterburner 304. For example, a less or greater amount of fuel and/or air may be used in processes that utilize turbine-less thermal cutterhead 303.

System Components

Figure 4:
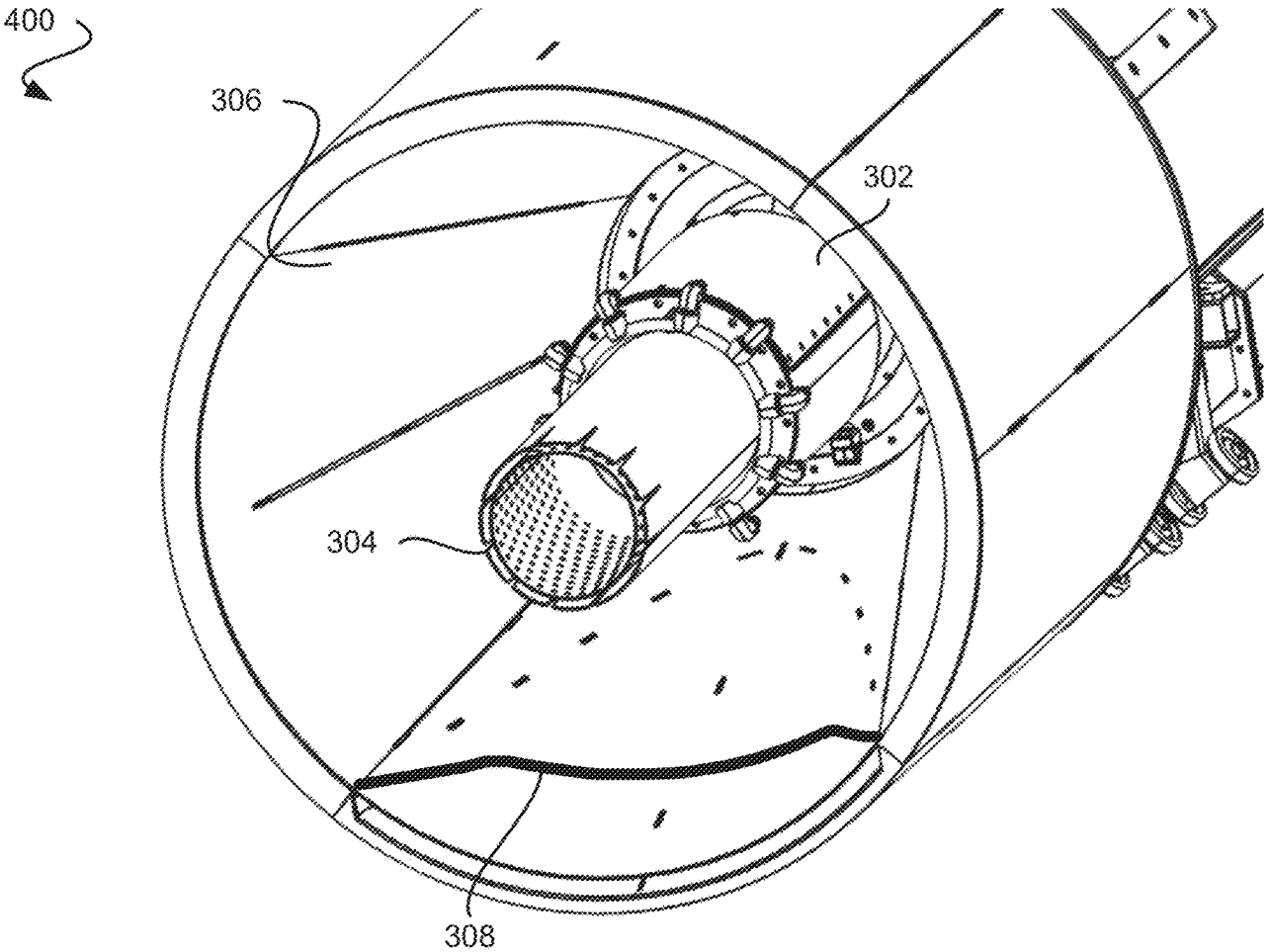
FIGS. 4-6 illustrate various views of portions of an example non-contact boring system, in accordance with certain embodiments.
Figure 5:
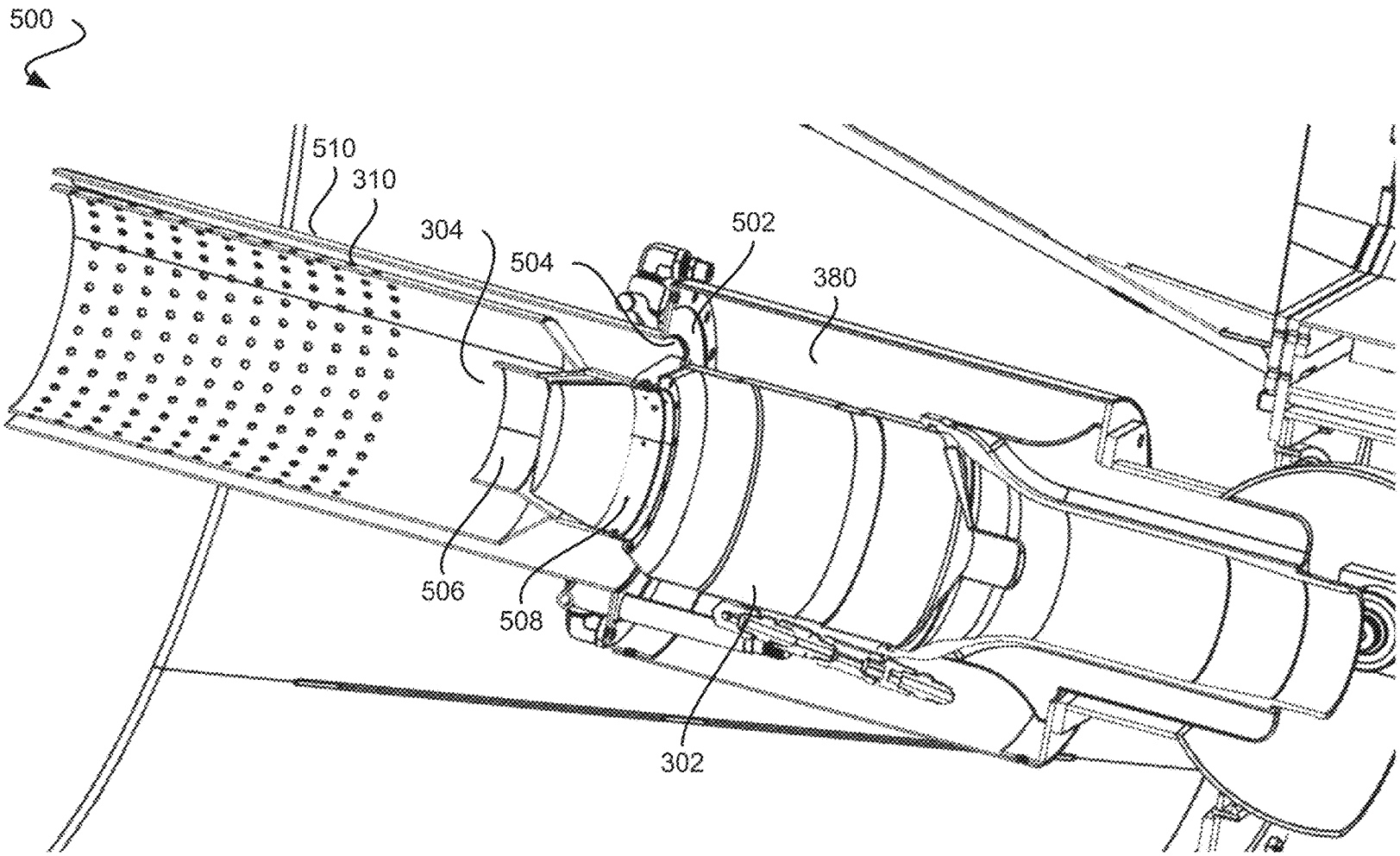
Figure 6:
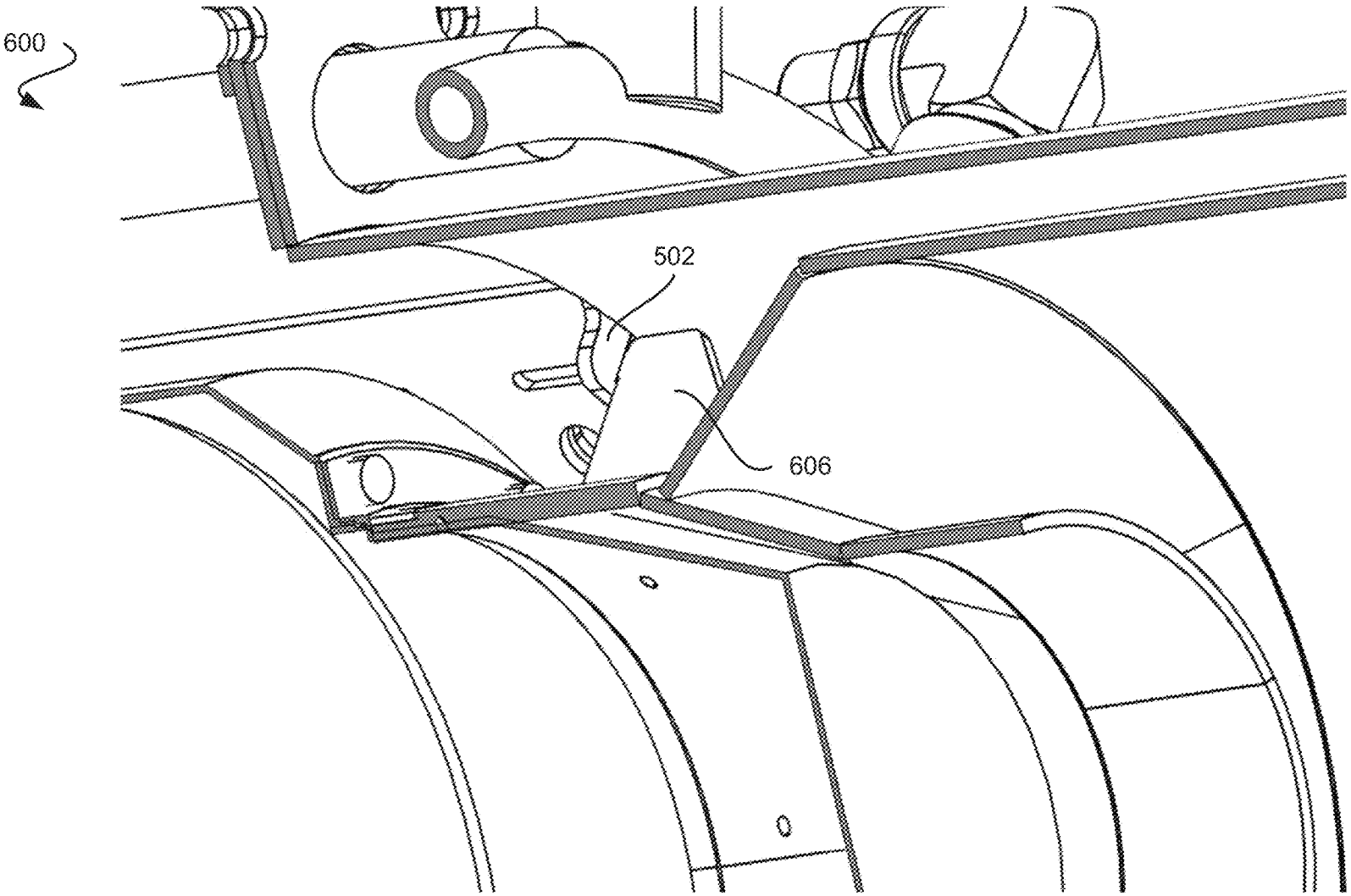

FIGS. 4-6 illustrate various views of portions of an example non-contact boring system, in accordance with certain embodiments.

FIG. 4 illustrates system 400, which includes conical system head 306 disposed around turbine 302 and afterburner 304 or portions thereof. As shown in FIG. 4, spoil removal opening 308 of conical system head 306 may be an opening or slot disposed within the bottom quarter of conical system head 306.

FIG. 5 illustrates system 500, showing features of turbine 302 and afterburner 304. As shown, turbine bypass 380 may be disposed around turbine 302 and allows for a flow path to afterburner 304. Such airflow may enter afterburner 304 through afterburner openings 310, which may be various openings around the shroud of afterburner 304.

Afterburner bracket 502 may hold afterburner 304 to turbine 302. Afterburner bracket 502 may include opening 504, which allows for airflow to pass from turbine bypass 380 to the portion defined by cooling shroud 510. Air flow within cooling shroud 510 may then flow into afterburner 304 through afterburner openings 310.

Additionally, FIG. 5 illustrates that afterburner 304 includes afterburner injector 508, where fuel may be injected into the flow path after turbine 302, and afterburner nozzle 506, which may direct the flame generated by afterburner 304.

In certain embodiments, afterburner nozzle 506 may include flame-holding features (e.g., grates, metal forms, and/or other such features) that may be configured to increase the stability of the afterburner flame. Such features may be positioned accordingly (e.g., if the flame holder is positioned in a recessed position, the flame may be unstable, while positions that are too far forward along the mass flow may cause the afterburner to not be able to light or be able to stay lit effectively).

FIG. 6 illustrates system 600, showing that afterburner bracket 502 includes reinforcing rib 606. Reinforcing rib 606 allows for airflow to pass between turbine 302 and afterburner 304 while providing for support.

Operation Examples

Figure 7:
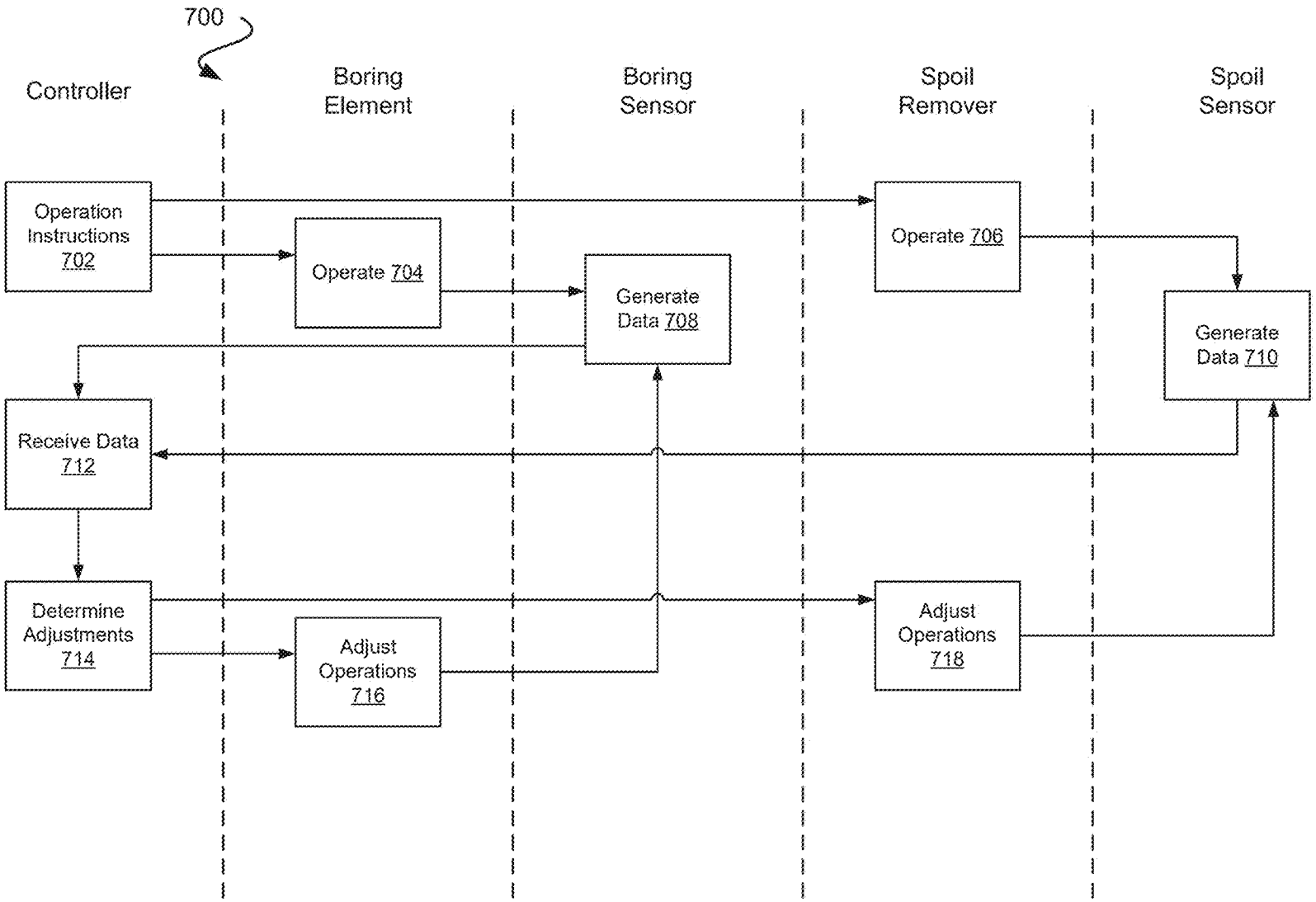
FIG. 7 is a system diagram illustrating a technique of operating an example boring system, in accordance with certain embodiments.

FIG. 7 is a system diagram illustrating a technique of operating an example boring system, in accordance with certain embodiments. FIG. 7 illustrates technique 700 that illustrates operation of an example boring system based on estimated mass flow from sensor readings.

In FIG. 7, technique 700 may be divided between actions between a controller, boring element, boring sensor, spoil removal system, and spoil sensor. In various embodiments, the controller may be any controller described herein. The boring element may be any contact or non-contact boring element described herein. In certain embodiments, the boring element may at least include a non-contact boring element. The boring sensor may be any sensor configured to determine data associated with one or more aspects of boring. The spoil remover may be configured to remove spoil from the bore face (e.g., may include structures such as a conical head). The spoil sensor may be any sensor configured to determine data associated with one or more aspects of spoil removal (e.g., sensing spoil removal rate or vacuum generated).

In 702, operations instructions may be stored within the controller and provided to the boring element and the spoil remover. The boring element may accordingly be operated in 704 and the spoil remover operated in 706. In various embodiments, the boring element operated may be, for example, a non-contact boring element as described herein. Operation of the non-contact boring element (which may be, for example, a turbine and/or an afterburner) may create pressure and airflow at the bore face. The spoil remover may be, for example, a conical head with a spoil removal opening. Operation of the spoil remover may include generating a vacuum to remove spoil from the bore face (e.g., through the spoil removal opening) and avoid back pressure for the turbine.

In 708, the boring sensor may generate data related to boring and the data may be received by the controller in 712. Such sensor may be any data indicative of boring, as described herein. In certain embodiments, the boring sensor may include pressure data indicating the air pressure generated by the turbine, the afterburner, and/or proximate to the bore face.

In 710, the spoil sensor may generate data related to spoil removal. Such data may include, for example, the amount of vacuum generated by the spoil remover (e.g., through the spoil removal opening). Alternatively or additionally, the data may indicate the size, shape, consistency, and/or other aspects of the spoil generated by boring. Such data may be communicated to the controller and received by the controller in 712.

Based on the data, the controller may determine whether any adjustments that are needed, in 714. Thus, for example, the spoil sensor may be configured to determine the particle size distribution of the spall created by non-contact boring. The size of the spall may be a function of stand-off and boring parameters (which may, for example, define the characteristic profile of the flame of an afterburner, in terms of temperature, mass flow). The spoil sensor allows for the determination of current spoil conditions, allowing for the controller to adjust/tune the stand-off and boring parameters so that the non-contact boring may produce a spoil particle size distribution that is highly efficient for efficient spoil evacuation.

Non-contact boring techniques may produce a wide range distribution of particle sizes (e.g., from dust to chips the size of fingernails, to larger palm size chips, and spoil which may be much wider in one dimension, such as thing disc like shapes). Accordingly, the spoil sensor may determine the distribution of such spoil and adjust operation of the boring element to produce the desired spoil distribution. By contrast, contact boring tehcniques typically produce spoils that are broken in large chunks, which are suspended in a fluid for removal. The fluid may need to be run through a post processing, separation process for analysis of the spoils. Otherwise, if contact boring spoils are not suspended in fluid, the spoil may need to be manually removed (e.g., with buckets). Thus, for contact boring techniques, spoil analysis may not be needed.

Thermal cutterheads may be operated at various power levels. For example, output from a turbine, a torch, an afterburner, and/or another such thermal cutterhand may be increased in power (e.g., in heat and thrust outputted by the torch) when airflow and/or fuel flow is increased. The airflow and/or fuel flow may cause an increase in mass flow through the system. The increase in power may cause an increase in spoil creation, further increasing mass flow. The vacuum produced may then need to be accordingly increased in order to remove the mass from the system and allow for steady state operating conditions. Thus, an adjustment of one aspect of boring, such as the power level, may require corresponding adjustments in other aspects to maintain effective boring operations.

In 716, boring operations may be adjusted. Adjustment of the boring operations may include, for example, adjustment of operational parameters (e.g., stand-off distance, fuel flow rates, air flow rates to the turbine and/or afterburner, and/or other such aspects), switching between non-contact and contact boring operations, and/or other such adjustments.

Alternatively or additionally, mass flow of the boring system may be adjusted. For example, the airflow rate of air entering the boring system (e.g., turbine and/or afterburner) may be adjusted, water may be flowed to the bore face (e.g., for steam), and/or the flow of other masses may be adjusted. In certain embodiments, the sensors of the system may, for example, detect the presence of foreign gases within a borehole. Based on the detection of the foreign gases and/or based on a detection of a flame front (e.g., due to combustion caused by the foreign gases), shielding gases (e.g., from a shielding gas source on the chassis and/or from an onsite facility) may be flowed to the bore face and/or portions of the borehole to neutralize, prevent, contain, choke, and/or extinguish any combustion.

In another embodiment, various features of the turbine may be adjusted. For example, the turbine may include specific elements such as the number and size of capillary tubes (e.g., certain capillary tubes may be unused in certain operations and only opened if conditions determine that it is advantageous), the afterburner may include elements such as a flame holder position (which may be adjustable), hole pattern (e.g., where there is a plurality of holes and one, some, or all such holes may be utilized) and/or air fuel mixture to effect ignition as well as flame stability. Backup system elements such as lengths and diameter of hoses (e.g., where there are one or more flow paths and only one, some, or all such flow paths are utilized, based on conditions), volume CFM of airflow, volume GPM of liquid flow, temperature of the operation and various forms of active and passive cooling, as well as various components described herein, may also be adjusted.

In 718, operation of the spoil remover may be adjusted. Adjustment of the spoil remover may include, for example, adjustment of the amount of vacuum generated by the spoil remover. In various embodiments, adjustment of the spoil remover may be concurrent with the adjustment of boring operations. Thus, for example, both the air flow rate and the vacuum generation may be adjusted, in order to optimize mass flow for boring operations.

In an example scenario, the boring system may first be operated in soft soil condition. Geological conditions may then change a rock may block the bore face. The sensors may detect the presence of a boulder instead of soft soil conditions (e.g., based on boring rates) and non-contact boring may then be utilized to fracture and fragment the boulder. Non-contact boring may cause the boulder to crack, but, depending on size, may not shatter into very thin disks and, instead, the particle distribution may be quite large. The particle size may be potentially too large for the spoil remover of the non-contact boring system. The spoil sensors may detect the size of the spoil (e.g., due to abnormal mass flow readings) and/or, due to the size of the spoil, back pressure may be detected by the non-contact boring system. Thus sensor readings may indicate that the obstruction cannot be fully cleared with non-contact boring and, instead, another boring technique may be utilized to fully break the cracked boulder and clear the spoil. In another embodiment, operation of the spoil remover and/or boring element may be adjusted to eliminate the back pressure (e.g., by reducing the pressure generated by the turbine/afterburner or increasing the vacuum generated by the spoil remover).

In various embodiments, the air fuel mixture of a turbine and/or afterburner may be tuned for different types of ground conditions (e.g., for efficiency and/or performance). Thus, for example, the air fuel mixture may be tuned to expend the least amount of specific energy removing/fragmenting/excavating a volume of rock. For example, basalt may have a different mass flow mixture than granite because they have different physical, chemical, and material properties. Such differences may warrant different boring parameters.

Computing System Examples

Figure 8:
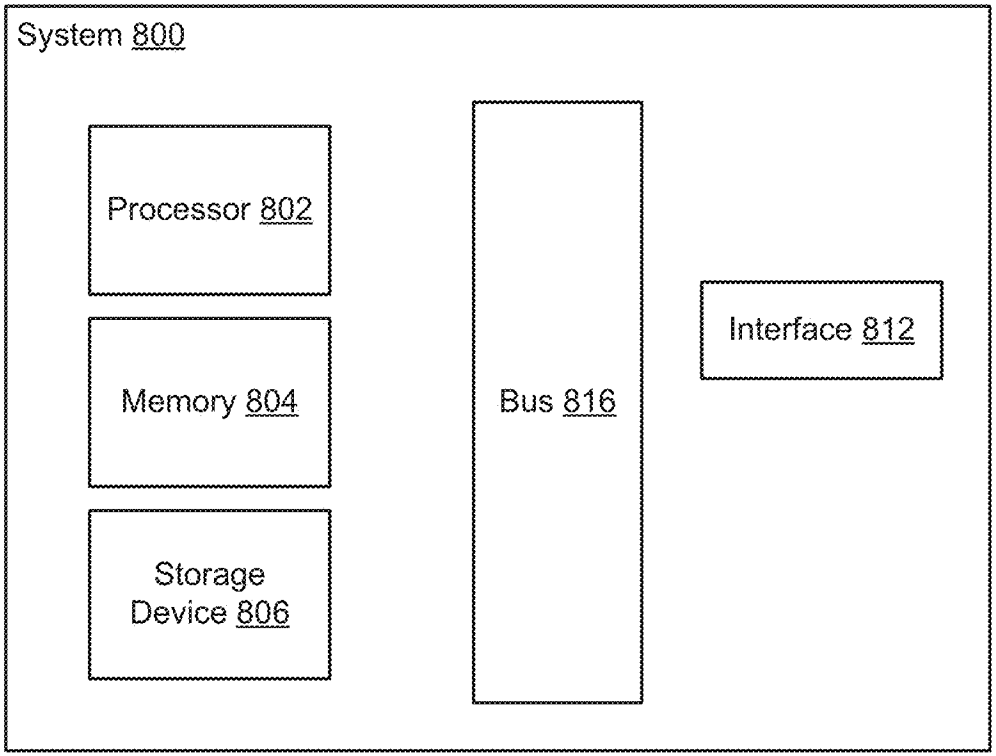
FIG. 8 illustrates a block diagram of an example computing system, in accordance with certain embodiments.

FIG. 8 illustrates a block diagram of an example computing system, in accordance with certain embodiments. According to various embodiments, a system 800 suitable for implementing embodiments described herein includes a processor 802, a memory module 804, a storage device 806, an interface 812, and a bus 816 (e.g., a PCI bus or other interconnection fabric.) System 800 may operate as a variety of devices such as a server system such as an application server and a database server, a client system such as a laptop, desktop, smartphone, tablet, wearable device, set top box, etc., or any other device or service described herein.

Although a particular configuration is described, a variety of alternative configurations are possible. The processor 802 may perform operations such as those described herein. Instructions for performing such operations may be embodied in the memory 804, on one or more non-transitory computer readable media, or on some other storage device. Various specially configured devices can also be used in place of or in addition to the processor 802. The interface 812 may be configured to send and receive data packets over a network. Examples of supported interfaces include, but are not limited to: Ethernet, fast Ethernet, Gigabit Ethernet, frame relay, cable, digital subscriber line (DSL), token ring, Asynchronous Transfer Mode (ATM), High-Speed Serial Interface (HSSI), and Fiber Distributed Data Interface (FDDI). These interfaces may include ports appropriate for communication with the appropriate media. They may also include an independent processor and/or volatile RAM. A computer system or computing device may include or communicate with a monitor, printer, or other suitable display for providing any of the results mentioned herein to a user.

Technique Examples

Figure 9:
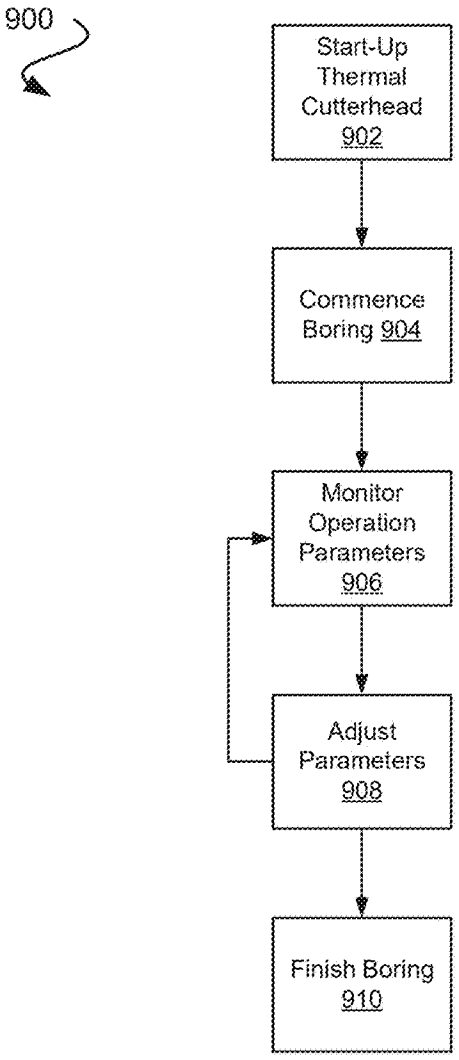
FIG. 9 is a flowchart illustrating a technique of operating an example boring system, in accordance with certain embodiments.

FIG. 9 is a flowchart illustrating a technique of operating an example boring system, in accordance with certain embodiments. Technique 900 of FIG. 9 illustrates the operation and adjustment of various aspects of a system as described herein, including the operation and adjustment of mass flow through such systems.

In 902, a start-up sequence for the thermal cutterhead may be performed. The start-up sequence for the thermal cutterhead may include management of a plurality of parameters, such one or more fuel flows, air flows, and/or throttle parameters. Such elements may be interconnected. That is, adjustment of one parameter may require corresponding adjustment of other parameters to maintain effective thermal spallation.

In certain embodiments, such start-up sequences may be performed via one or more "recipes" where an operator may set parameters for each step of a startup process that includes a plurality of steps. A sequence of steps may be executed during the start-up sequence. Each step may be set to automatically execute when a particular condition or a plurality of conditions are met (e.g., when a time condition and/or threshold sensor reading, such as a temperature sensor reading, is met). Such conditions may be one condition, a combination of different conditions, or if one or a subset of a plurality of conditions are met.

In certain embodiments, a plurality of recipes may be provided to the system and the appropriate recipe may be selected based on determined conditions and/or operating preferences (e.g., for a cold start or a warm start). In various embodiments, the controller may select the appropriate recipe based on determined conditions (e.g., sensor readings) as well as allow an operator to manually guide the start-up process (e.g., manual override). Furthermore, the operator may tweak each such recipe in real time.

Once start-up of the thermal cutterhead has been performed, boring operations may commence in 904. Such boring operations may be performed according to the techniques described herein. Various operational parameters of the boring operations may be monitored (e.g., via one or more sensors) in 906. Thus, for example, data from such sensors may be received by one or more controllers of the system. Such data may allow the controllers to determine the operational condition of certain aspects of the system (e.g., the rate of mass flow entering or exiting from the bore face).

Based on such determinations, the operational parameters of boring operations may be adjusted in 908. Such adjustments may include adjusting the overall rate of mass flow, adjusting one or more mass flow parameters such as the rate of air provided by the air compressor, the volume of fuel flow, the operating speed of a turbine, the amount of vacuum created for spoil removal, and/or other such parameters. Such parameters may affect mass flow and changes in mass flow may affect operation of the system. Such changes may result in steady state or transient changes. For example, changes in total mass flow may be a steady state change until other operational parameters are changed while, in certain conditions, a transient increase in pressure (e.g., through increased air compressor volume) or vacuum (e.g., through increased vacuum for spoil removal) may be imparted at the bore face. Both steady state and transient changes may affect operation of boring operations, such as through affecting operation of the thermal cutterhead and/or conditions at the bore face.

In certain embodiments, examples of operational parameters that may be adjusted include: (1) throttle for the combuster of a thermal cutter (e.g., control of one or more inlets controlling mass air flow); (2) cooling airflow volumetric flow (e.g., airflow from air mass flow controls, such as from a blower or compressed air valve); (3) fuel delivery rate (as fuel is a very small percentage of the total mass flow, the effect of fuel delivery rate is more on control of the spallation process via combustion and temperature control and, thus, the characteristics of spallation); (4) water cooling flow (e.g., flow rate of liquid water that is converted to steam during the spallation process); (5) vacuum generated (to affect the removal of mass from the exit of the system-the vacuum rate may be varied to result in intentional or unintentional transient vacuum or pressure within the bore hole).

Characteristics of (1) to (4) may be determined from monitoring sensor data. (5) may be determined through operation of vacuum generating equipment, such operation of a vacuum generation system such as a vacuum truck. In various embodiments, such adjustments may be automatically performed by a controller (with or without human contributions or override) based on data received from the sensors.

Furthermore, mass flow from the casing or bore (e.g., mass flow between the casing or bore, as previously described) contributes to the total mass flow of the system. In various examples, the mass flow from the casing or bore may be cooling air flowing around the casing, but other embodiments may include airflow from another source. Though such mass flow may not be easily adjustable, based on the characteristics of such mass flow from the casing or bore, other parameters may be adjusted.

In addition to such parameters being utilized for adjustments, such parameters may also be adjusted during the start-up process, as described in 902.

For example, the power outputted by the thermal cutterhead may be changed (e.g., according to bore face conditions). Mass flow through the system may be adjusted in order to cause the thermal cutterhead to change the power provided by the system (e.g., the increasing mass flow of certain components may cause the thermal cutterhead to increase the power outputted). Additionally or alternatively, the mass flow through the system may be adjusted due to the change in power output (e.g., lower power outputs may result in less total mass flow) through adjustment of fuel and/or air flow. Additionally or alternatively, the direction of balance flow may also be adjusted. Such direction of balance flows may be transient conditions and may determine, for example, whether a greater amount of mass is going into or heading out of the system. Such balance flows may effect the characteristics of combustion (e.g., flame front geometry, flame temperature, and/or other such aspects), spoil removal, and/or other such aspects.

The monitoring and adjusting of the parameters may be repeatedly performed until boring operations have finished, in 910.

Conclusion

Although the foregoing concepts have been described in some detail for purposes of clarity of understanding, it will be apparent that certain changes and modifications may be practiced within the scope of the appended claims. It should be noted that there are many alternative ways of implementing the processes, systems, and apparatuses. Accordingly, the present embodiments are to be considered illustrative and not restrictive.

What is claimed is:

1. A system comprising a non-contact boring element configured to perform thermal spallation on a bore face of a borehole;

a conical head comprising a spoil removal opening;

a vacuum unit fluidically coupled to the spoil removal opening and configured to generate a vacuum to remove spoil created by the thermal spallation;

a first sensor, configured to determine a rate of mass flow through the non-contact boring element;

a second sensor, configured to determine an amount of the vacuum generated by the vacuum unit; and a controller, communicatively coupled to the first sensor and the second sensor, and configured to:

receive the rate of mass flow through the non-contact boring element, determined by the first sensor;

receive the amount of the vacuum, determined by the second sensor generated; and adjust operation of the non-contact boring element and/or the first vacuum unit based on the rate of mass flow, received from the first sensor, and the determined amount of the vacuum, received from the second sensor, wherein the operation, adjusted by the controller, is selected from the group consisting of power output, stand-off distance, and positioning of the non-contact boring element.

2. The system of claim 1, wherein the controller is further configured to determine that back pressure for the non-contact boring element needs to be eliminated, as part of adjusting the operation of the non-contact boring element.

3. The system of claim 1, wherein the non-contact boring element comprises a turbine.

4. The system of claim 3, wherein the turbine comprises an afterburner.

5. The system of claim 1, wherein the conical head is disposed around at least a portion of the non-contact boring element.

6. The system of claim 1, wherein the conical head is configured to utilize the mass flow from operation of the non-contact boring element and/or the vacuum to cause spoil generated by the thermal spallation to circulate within air in front of the bore face.

7. The system of claim 1, further comprising:

a third sensor, configured to determine an orientation of the system, wherein the controller is further configured to:

receive the orientation of the system from the third sensor; and adjust the operation of the non-contact boring element and/or the vacuum unit based on the orientation of the system, received from the third sensor, in addition to the rate of mass flow, received from the first sensor, and the amount of the vacuum, received from the second sensor.

8. The system of claim 7, wherein the determining the orientation of the system comprises determining that the system is oriented in a downward direction.

9. The system of claim 8, wherein the adjusting the operation of the non- contact boring element and/or the vacuum unit based on the orientation of the system comprises increasing the amount of the vacuum generated and/or decreasing the rate of the mass flow.

10. The system of claim 7, wherein the determining the orientation of the system comprises determining that the system is oriented in an upward direction.

11. The system of claim 10, wherein the adjusting the operation of the non-contact boring element and/or the vacuum unit based on the orientation of the system comprises decreasing the amount of the vacuum generated and/or increasing the rate of the mass flow.

12. The system of claim 1, further comprising:

a fourth sensor configured to detect movement of the conical head relative to the non-contact boring element, wherein the controller is further configured to:

receive the movement of the conical head relative to the non-contact boring element from the fourth sensor; and determine that the conical head has contacted a portion of the borehole.

13. The system of claim 12, wherein the controller is further configured to:

adjust a direction of the non-contact boring element based on determining that the conical head has contacted the portion of the borehole, in addition to adjust the operation of the non-contact boring element and/or the vacuum unit based on the rate of mass flow, received from the first sensor, and the amount of the vacuum, received from the second sensor.

14. A method comprising:

performing, with a non-contact boring element, thermal spallation on a bore face of a borehole;

generating, using a vacuum unit, a vacuum to remove spoil created by the thermal spallation;

determining, with a first sensor, a rate of mass flow through the non-contact boring;

determining, with a second sensor, an amount of the vacuum generated by a vacuum unit wherein the vacuum unit is fluidically coupled to a spoil removal opening in a conical head; and adjusting, with a controller, operation of the non-contact boring element and/or the vacuum unit based on the rate of mass flow, received from the first sensor, and the amount of the vacuum, received from the second sensor, wherein the operation, adjusted by the controller, is selected from the group consisting of power output, stand-off distance, and positioning of the non-contact boring element.

15. The method of claim 14, wherein the adjusting the operation of the non-contact boring element comprises eliminating back pressure for the non-contact boring element.

16. The method of claim 15, further comprising:

determining that the amount of the vacuum is less than or equal to the rate of the mass flow, wherein the eliminating the back pressure for the non-contact boring element comprises operating the vacuum unit such that the amount of the vacuum is greater than the rate of mass flow.

17. The method of claim 14, wherein the conical head is configured to utilize the mass flow from operation of the non-contact boring element and/or the vacuum to cause spoil generated by the thermal spallation to circulate within air in front of the bore face.

18. The method of claim 14, wherein the non-contact boring element comprises a turbine.

19. The method of claim 18, wherein the turbine comprises an afterburner.

* * * * *